US010669083B2

(12) United States Patent
McPherson

(10) Patent No.: US 10,669,083 B2
(45) Date of Patent: Jun. 2, 2020

(54) TAMPER-EVIDENT CLOSURE

(71) Applicant: Obrist Closures Switzerland GmbH, Reinach (CH)

(72) Inventor: Alexander Donald Meiklem McPherson, Central Scotland (GB)

(73) Assignee: GCL International S.A.R.L., Luxembourg (LU)

( * ) Notice: Subject to any disclaimer, the term of this patent is extended or adjusted under 35 U.S.C. 154(b) by 37 days.

(21) Appl. No.: 15/115,665

(22) PCT Filed: Jan. 19, 2015

(86) PCT No.: PCT/EP2015/050894
§ 371 (c)(1),
(2) Date: Jul. 30, 2016

(87) PCT Pub. No.: WO2015/113851
PCT Pub. Date: Aug. 6, 2015

(65) Prior Publication Data

US 2017/0137189 A1 May 18, 2017

(30) Foreign Application Priority Data

Jan. 31, 2014 (GB) ..... 1401682.8

(51) Int. Cl.
*B65D 41/62* (2006.01)
*B65D 41/34* (2006.01)
(Continued)

(52) U.S. Cl.
CPC ..... *B65D 55/024* (2013.01); *B65D 41/34* (2013.01); *B65D 55/06* (2013.01);
(Continued)

(58) Field of Classification Search
CPC ..... B65D 55/024; B65D 55/06; B65D 41/34; B65D 2101/0053; B65D 43/0285;
(Continued)

(56) References Cited

U.S. PATENT DOCUMENTS 1,481,034 A * 1/1924 Stattmann ..... B65D 41/62 215/251
1,875,431 A * 9/1932 Fabrice ..... B65D 41/3485 215/251
(Continued)

FOREIGN PATENT DOCUMENTS

CN 201825373 5/2011
DE 4441435 7/1995
(Continued)

*Primary Examiner* — Gideon R Weinerth
(74) *Attorney, Agent, or Firm* — Lightbulb IP, LLC

(57) ABSTRACT

A tamper-evident closure (1) for a container, the closure comprising: a shell comprising a first shell part (3A) and a second shell part (3B); and a tamper-evident overcap, the overcap comprising a cap (4A) which is fixed to the exterior of the first shell part and a tamper-evident member (4B) which is releasably connected to the cap (4A) and releasably located around the exterior of at least part of the second shell part (3B), such that the first and second shell parts (3A, 3B) cannot be separated unless the member (4B) is released, and thereafter the cap (4A) is removable together with the first shell part (3A).

20 Claims, 27 Drawing Sheets

(51) Int. Cl.

| | |
|---|---|
| ***B65D 41/32*** | (2006.01) |
| ***B65D 50/00*** | (2006.01) |
| ***B65D 51/18*** | (2006.01) |
| ***B65D 55/02*** | (2006.01) |
| ***B65D 55/06*** | (2006.01) |
| *B65D 49/02* | (2006.01) |

(52) U.S. Cl.
CPC ..... *B65D 41/3428* (2013.01); *B65D 41/62* (2013.01); *B65D 49/02* (2013.01); *B65D 2101/0038* (2013.01); *B65D 2101/0053* (2013.01); *Y10S 215/901* (2013.01)

(58) Field of Classification Search
CPC ..... B65D 49/02; B65D 41/3457; B65D 2101/0061; B65D 2101/0076; B65D 2101/0084; B65D 2101/0092; B65D 2101/0046; B65D 2101/0038; B65D 2101/0023; B65D 41/62; B65D 41/48; B65D 41/3428; B65D 41/0235; B65D 41/0492; B65D 41/348; Y10S 215/901
USPC ..... 220/259.3, 254.9, 255, 254.1; 215/255, 215/256, 258, 253, 251, 230, 274, 316, 215/250
See application file for complete search history.

(56) References Cited

U.S. PATENT DOCUMENTS 1,881,529 A * 10/1932 Hammer ..... B65D 41/3485 215/256
2,806,620 A * 9/1957 Blanch ..... B65D 41/62 215/251
2,851,184 A * 9/1958 Strode ..... B65D 41/42 215/250
3,109,547 A * 11/1963 Wood ..... B65D 41/485 215/256
3,335,889 A * 8/1967 Brumme ..... B65D 41/348 215/252
3,392,862 A * 7/1968 Faulstich ..... B65D 41/48 215/254
3,608,765 A * 9/1971 Faulstich ..... B65D 41/485 215/256
3,901,403 A * 8/1975 Menke ..... B65D 41/62 215/251
3,930,588 A * 1/1976 Coursaut ..... B65D 41/348 215/230
3,957,169 A * 5/1976 Coursaut ..... B65D 41/348 215/253
3,974,932 A * 8/1976 Faulstich ..... B65D 41/485 215/256
4,029,231 A * 6/1977 Jonsson ..... B65D 50/045 215/224
4,109,816 A * 8/1978 Faulstich ..... B65D 41/485 215/256
4,567,992 A * 2/1986 Davis ..... B65D 41/36 215/222
4,899,898 A * 2/1990 Thompson ..... B29C 45/4407 215/252
4,911,316 A * 3/1990 Tackles ..... B65D 41/48 215/256
5,123,555 A * 6/1992 Luch ..... B65D 41/48 215/250
5,445,284 A * 8/1995 Guest ..... B65D 41/348 215/252
5,460,287 A * 10/1995 Cargile ..... B65D 43/0256 215/256
5,593,055 A * 1/1997 Repp ..... B65D 1/023 215/256
5,711,443 A * 1/1998 Bennett ..... B65D 41/3428 215/251
5,740,932 A 4/1998 Battegazzore
6,050,436 A * 4/2000 Bennett ..... B65D 41/3428 215/251
7,398,890 B2 * 7/2008 Thomson ..... B65D 49/04 215/21
7,581,653 B2 * 9/2009 Perrin ..... B65D 41/48 215/253
8,177,083 B2 * 5/2012 Lamoureux ..... B65D 41/48 215/255
8,231,019 B2 * 7/2012 Battegazzore ..... B65D 41/0492 215/251
8,281,944 B2 * 10/2012 Battegazzore ..... B65D 41/3428 215/219
10,196,191 B2 * 2/2019 Torrent Ortega .... B65D 47/123
2007/0090110 A1 * 4/2007 Skelton ..... B65D 41/0478 220/254.9
2009/0289027 A1 * 11/2009 Torrent Ortega .... B65D 41/348 215/352
2009/0301987 A1 * 12/2009 Luzzato ..... B65D 41/045 215/253
2010/0170898 A1 * 7/2010 Skelton ..... B65D 55/022 220/214
2010/0258521 A1 * 10/2010 Bertolaso ..... B65D 41/3438 215/253
2011/0259844 A1 * 10/2011 Skelton ..... B65D 49/04 215/201
2012/0055899 A1 * 3/2012 Parmaningsih ..... B65D 41/485 215/255
2014/0048537 A1 * 2/2014 McPherson ..... B65D 49/04 220/276
2014/0054288 A1 * 2/2014 McPherson ..... B65D 49/02 220/255.1
2016/0060007 A1 * 3/2016 McPherson ..... B65D 41/28 220/259.3
2020/0062467 A1 * 2/2020 McPherson ..... B29C 45/1676

FOREIGN PATENT DOCUMENTS

| | | |
|---|---|---|
| EP | 0711711 | 5/1996 |
| FR | 546991 | 11/1922 |
| GB | 2302867 | 2/1997 |
| JP | 52-15492 | 7/1975 |
| JP | 54-34840 | 8/1977 |
| JP | 07-237651 | 9/1995 |
| WO | WO2006079351 | 8/2006 |
| WO | WO2008110917 | 9/2008 |
| WO | WO2013068750 | 5/2013 |
| WO | WO2013079545 | 6/2013 |
| WO | WO2013113435 | 8/2013 |
| WO | WO2014016391 | 1/2014 |

* cited by examiner

TAMPER-EVIDENT CLOSURE

The present invention relates generally to a closure for a container and particularly to a closure with means for indicating that the closure has been opened at least once.

There is an increasing demand for tamper-indicating systems which ensure that a container is not re-filled with non-original contents. Whilst it is relatively easy to produce some form of tamper-evidence, it is much more difficult to provide tamper-evidence which cannot be either overcome without causing the tamper-evidence system to activate, or activated and then returned to a visually identical state so as to appear non-activated.

A particularly useful method of providing tamper-evidence is to use a system in which a closure is initially located into a first position, but once removed can only be returned to a second position which is visually distinct from the first position. For example, U.S. Pat. No. 5,738,231 describes a closure with a part which is moved during the opening process so that following opening it cannot pass back over a projection on the container finish. The result is that the closure can only return to a position in which it is axially displaced with respect to its original position.

Document WO 02/096771 describes a closure with a first portion with inner and outer parts, and a second portion. Initially a section of the inner part of the first portion protrudes below the level if the second portion which is formed so as to have a reduced circumference. When the first portion is removed the section of the inner part is pulled from under the area of reduced circumference on the second portion. After removal the inner part of the first portion and the area of reduced circumference on the second portion retain their original dimensions, so that if the first portion is reapplied the inner part can no longer pass under the area of reduced circumference.

Documents WO2005/049449 and WO2006/117505 describe a tamper-evident closure with a first portion including inner and outer parts, and a second portion. The outer part is movable relative to the inner part from a first position in which the outer part is immediately adjacent the second portion said outer part is movable to a second position in which there is an unobstructed gap therebetween. The inner and outer parts are adapted to become irreversibly locked in the second position so that the outer part cannot be moved back to the first position to close the gap so as to provide an irreversible event which gives evidence of opening.

The present invention seeks to provide improvements over the prior art.

According to an aspect of the present invention there is provided a tamper-evident closure for a container, the closure comprising: a shell comprising a first shell part and a second shell part; and a tamper-evident overcap, the overcap comprising a cap which is fixed to the exterior of the first shell part and a tamper-evident member which is releasably connected to the cap and releasably located around the exterior of at least part of the second shell part, such that the first and second shell parts cannot be separated unless the member is released, and thereafter the cap is removable together with the first shell part.

The result is that the first shell part cannot be removed from a container until the tamper-evident member is released.

The tamper-evident member is located (for example secured or fixed) around the exterior of second shell part. In other words, the member is separate from and extends about the part rather than, for example, being provided between/releasably held between the first and second shell parts.

In some embodiments the first and second shell parts are frangibly connected directly together i.e. they are connected without a tamper-evident member axially between them.

According to a further aspect there is provided a tamper-evident closure for a container, the closure comprising: a shell comprising a first shell part and a second shell part; a tamper-evident overcap, the overcap comprising a cap which is fixed to the first shell part and a tamper-evident member which is releasably connected to the cap and releasably fixed to the second shell part, such that the first and second shell cannot be separated unless the member is released, and thereafter the cap is removable together with the first shell part.

The result is that the first shell part cannot be removed from a container until the tamper-evident member is released.

The closure may further comprise a first portion including inner and outer parts, and a second portion, the first portion being connected or connectable to the second portion and removable therefrom, the inner and outer parts being movable upon first opening of the closure from the first position to a second position in which there is a gap between at least part of the first and second portions, the closure comprising means for preventing the first portion from returning to the first position so as to maintain the gap.

The outer part may be movable relative to the inner part from a first position in which the first and second shell parts are adjacent each other to a second position in which there is a gap therebetween, the closure comprises locking means for locking the closure in the second position upon first opening so that the gap cannot easily be closed.

Closures formed with inner and outer parts may include means for preventing the inner part from moving relative to the second portion until the other part has reached the second position. If the inner part can move relative to the second portion before the outer part has reached its second position (to generate the gap) there is a risk that the closure could be returned to a closed position without the gap having been generated. The present invention may be configured to prevent this.

The closure comprises a shell. A metal (such as aluminium) shell, cowl or the like may be provided to house working components. In gap-forming embodiments the gap may be formed in the shell. The shell parts may be joined by a line of weakness when the closure is in the unopened state. For example, a frangible line may be provided in the shell, the gap being formed between adjacent peripheries of two shell parts along which the line extends.

The gap may be obstructed. Alternatively, the gap may be unobstructed. By 'unobstructed' it is meant there is no obstruction at or through the gap. The closure thereby does not rely on an obstructing member becoming trapped at or in the shell gap. By forming an unobstructed gap it is not possible to defeat the tamper-evidence by a simple cutting operation through the gap. In other words, the locking mechanism may be remote from the gap.

The tamper-evident member may be frangibly connected to a free end of the cap.

The member may include anti-rotation features for engaging corresponding features on the second shell part.

A seal or the like may be carried on or by the member. In some embodiments the member is formed with a portion reminiscent of a piece of wax, lead, or other material with a design stamped into it and attached to things as a guarantee of authenticity.

The cap may be friction fitted onto the first shell part. In some embodiments an adhesive may alternatively or additionally used.

In some embodiments the first shell part must be rotated relative to the second shell part to open the closure.

Where present, the second portion may be attachable to a container. For example, the second portion may be attachable to the mouth and neck region of a container. In some embodiments the second portion may be snap-fittable onto a container. Roll-on-pilfer-proof (ROPP) arrangements are also contemplated.

The second portion may comprise or include a pouring fitment.

The closure may further comprise a non-return valve. Certain industries, in particular the spirits industry, demand additional measures to prevent tampering. In-bore fitments such as non-return fitments are often fitted to containers to prevent re-filling regardless of other tamper-evidence measures.

The closure may include a ratchet arrangement for preventing return to the first position, for example by locking inner and outer parts in the second position. A ratchet arrangement is a simple and efficient method of irreversibly locking the inner and outer parts together. Advantageously the locking means which initially hold the inner part on the body may subsequently prevent, or help prevent, the outer part returning to the first position.

The body part may include formations, such as screw threads, for engagement on the container or in-bore fitment as appropriate. In such cases the cap ratchet arrangement or other locking mechanism may be located above the formations so as to increase the difficulty in accessing and tampering with the locking arrangement.

The member may be a tamper-evident band, strap or the like. The band may be generally annular. The band may extend around part, substantially all or all of the second part. It may extend axially over part, substantially all or all of the second part.

The cap and tamper-evident band may be formed as a single piece.

The cap and tamper-evident band may be frangibly connected together. For example the frangible connection may be provided by a plurality of frangible bridges between the cap and the band.

The tamper-evident member may include a section with the appearance of a seal.

In the unopened position the overcap may prevent axial separation and/or relative rotation of the first and second shell parts.

The present invention also provides a spirits bottle closure comprising a closure as described herein.

The present invention also provides in combination a closure as described herein and a container.

The present invention also provides a tamper-evident overcap for a closure container of the type having a shell comprising a first shell part and a second shell part, the overcap comprising: a cap which is fixable to the exterior of the first shell part and a tamper-evident member which is releasably connected to the cap and releasably locatable on the exterior of the second shell part, such that the first and second shell cannot be separated unless the member is released, and thereafter the cap is removable together with the first shell part.

The present invention also provides a tamper-evident closure for a container, the closure comprising: a generally circular cylindrical sleeve comprising a first sleeve part and a second sleeve part; and a generally circular cylindrical tamper-evident overcap, the overcap having a greater diameter than the sleeve; the overcap comprising a top cap which is fixed to the exterior of the first sleeve part and a tamper-evident member which is releasably connected to the cap and releasably fixed around the exterior of at least part of the second sleeve part, such that the first and second sleeve parts cannot be separated unless the member is released, and thereafter the cap is removable together with the first sleeve part.

The present invention also provides a container closure in combination with an overcap as described herein.

The present invention also provides a tamper-evident overcap for a closure container of the type having a shell comprising a first shell part and a second shell part, the overcap comprising: a cap which is fixable to the first shell part and a tamper-evident member which is releasably connected to the cap and releasably fixed to the second shell part, such that the first and second shell cannot be separated unless the member is released, and thereafter the cap is removable together with the first shell part.

An overcap formed according to the present invention may, in some embodiments, be retrofittable to pre-existing shells.

The present invention will now be more particularly described, by way of example, with reference to the accompanying drawings, in which.

Figure 1:
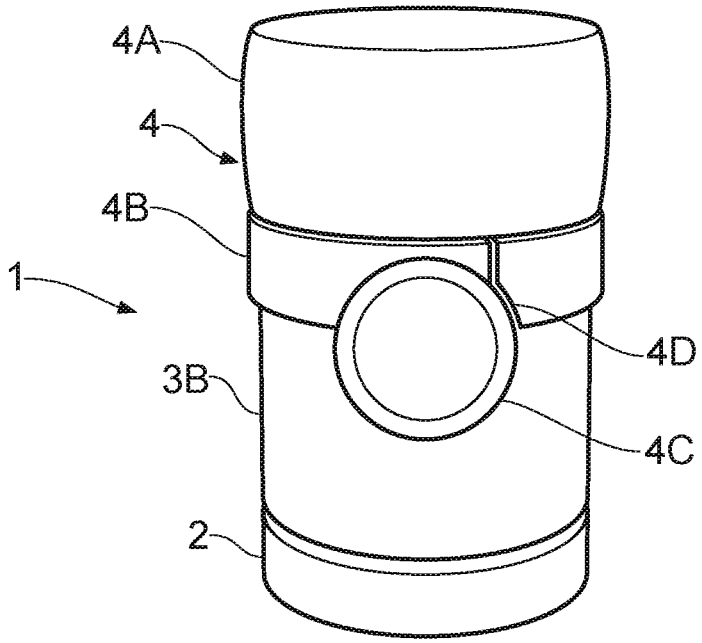
FIG. 1 is a side view of a closure formed according to the present invention and shown in a fully closed position.

Referring first to FIG. 1 there is shown a closure generally indicated 1 which is secured onto a container neck 2.

The closure comprises a shell 2 having a first shell part 3A (not shown) and a second shell part 3B. In this embodiment the shell 2 is formed from metal; in other embodiments a shell formed from a plastics material may, for example, be provided.

An overcap 4 is provided and fits on top of the first shell part 3A. The overcap 4 includes a cap part 4A and a tamper-evident band 4B. In this embodiment the overcap 4 is formed from a plastics material.

The cap part 4A is secured to the shell part 3A (in this embodiment by friction and an adhesive) and is frangibly connected to the band 4B at its free end.

The band 4B includes a generally disc-shape section 4C formed to appear like a seal. Around one side of the seal 4C a frangible line 4D extends.

The band 4B is removably secured to the shell part 3B, so that the cap part (carried on the shell part 3A) cannot be removed.

Figure 2:
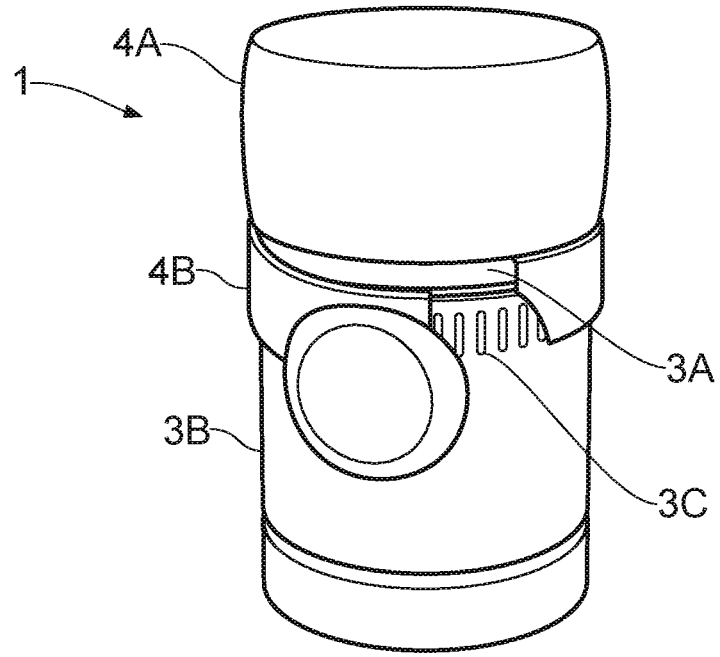
FIG. 2 is a side view of the closure of FIG. 1 shown with a tamper-evident band partially removed.
Figure 3:
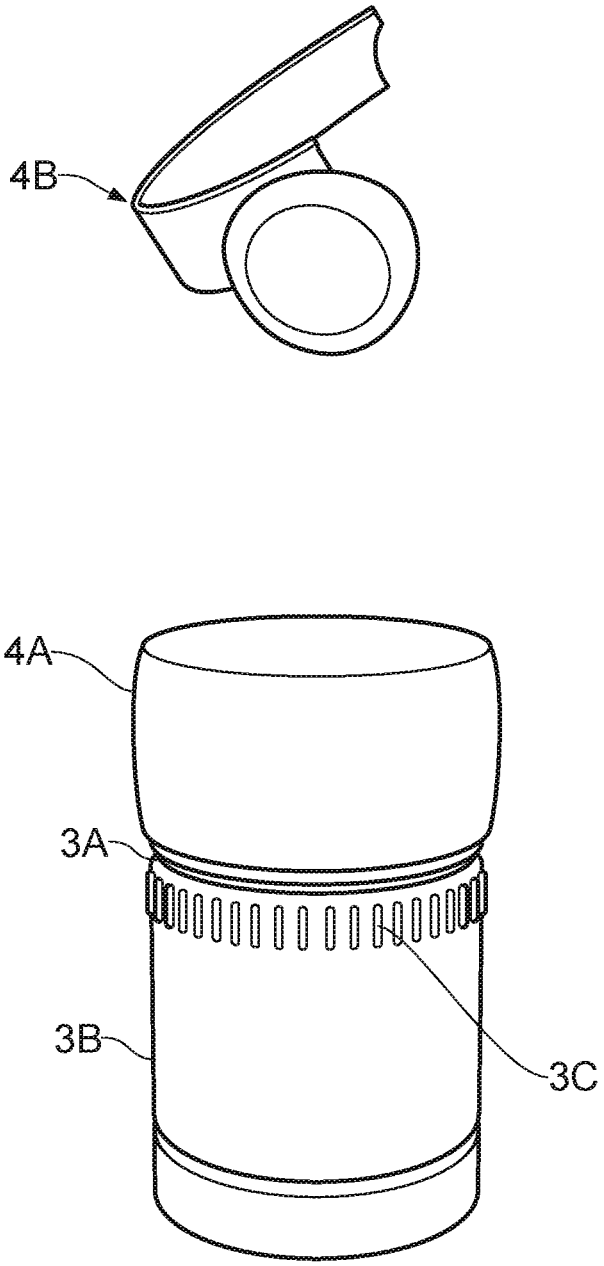
FIG. 3 shows the closure with the tamper-evident band fully removed.

In order to remove the cap part 4A the band 4B must first be released. This is achieved by lifting the seal 4C to cause the line 4D to break as shown in FIG. 2 (in which the shell part 3A can now be seen). The seal 4C can then be pulled to tear it away from the free end of the cap 4A as shown in FIG. 3. FIGS. 2 and 3 also show axial ribs 3C provided on the outer surface of the shell part 3B for engaging corresponding ribs on the band to prevent the band 4B from rotating.

Figure 4:
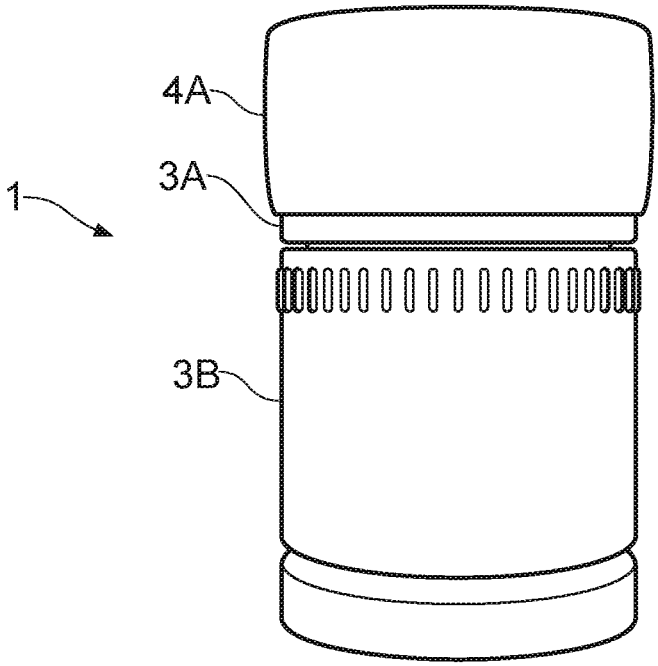
FIG. 4 is a side elevation of the closure of FIG. 3.

In FIG. 4 the band is shown completely removed. This allows a user to grasp the cap part 4A and unscrew it (in other embodiments the overcap could, for example, be pulled off rather than unscrewed). The cap part 4A is secured to the shell part 3A so that they co-rotate off the container neck.

Figure 5:
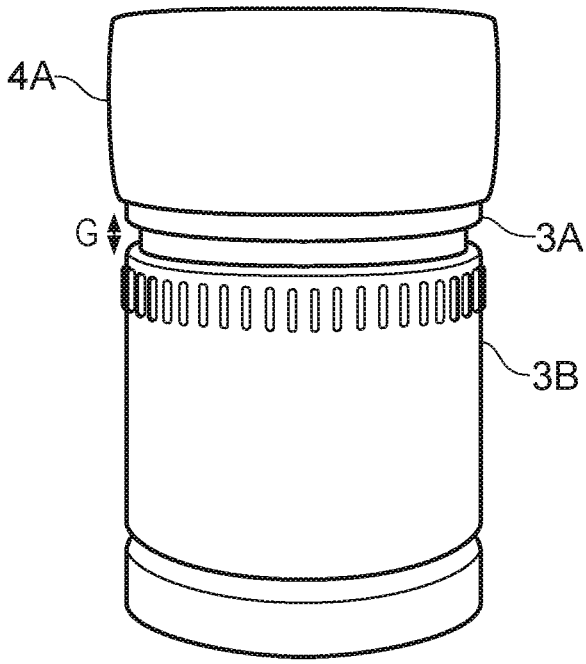
FIG. 5 is a side elevation of the closure of FIG. 4 shown with a cap partially removed.

In this embodiment a gap generating mechanism is provided (further details of which are provided below). Accordingly, in an initial rotation phase, the cap/shell part rotation causes the shell parts to be separated (in this embodiment a frangible line between the parts is initially present and is broken) a gap G to open up between the shell parts as shown in FIG. 5.

Figure 6:
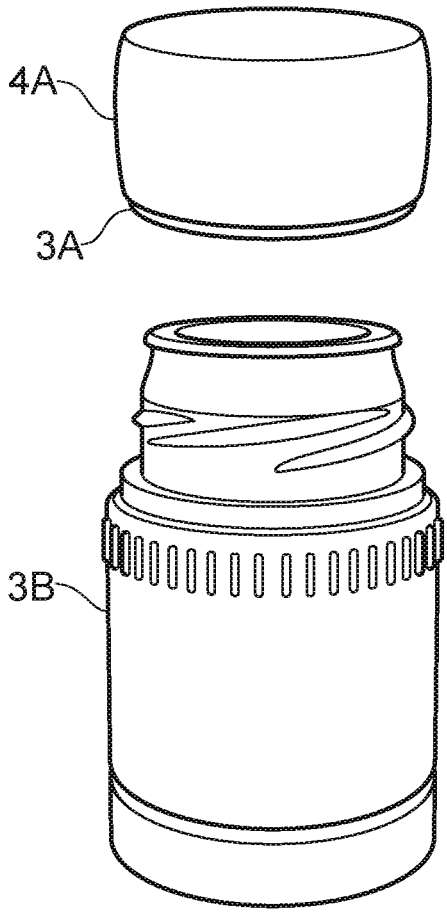
FIG. 6 shows the closure of FIG. 5 with the cap fully removed.

Continued rotation then causes the cap/shell part to be rotated off the neck as shown in FIG. 6.

Figure 7:
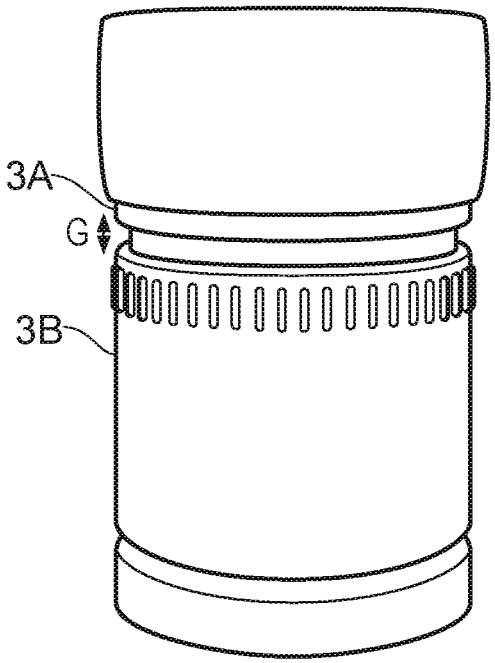
FIG. 7 shows the closure of FIG. 6 with the cap replaced.

When the cap/shell part are replaced, the gap G between the shell parts remains and cannot be reclosed, as shown in FIG. 7.

Figure 8A:
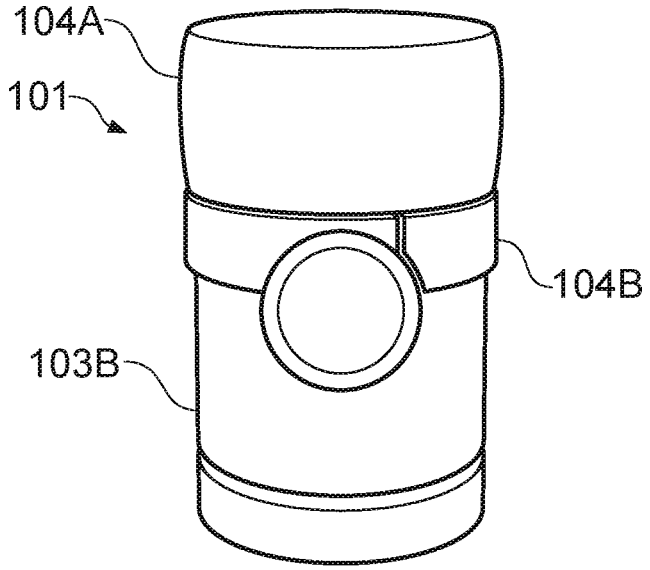
FIG. 8A is a side view of a closure formed according to an alternative embodiment shown in an unopened state.
Figure 8B:
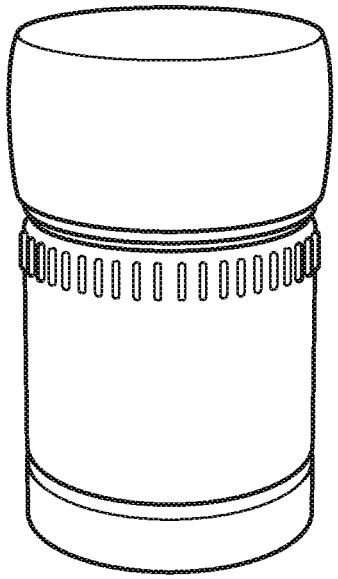
FIG. 8B is a side view of the closure of FIG. 8A with a tamper-evident member released.
Figure 8C:
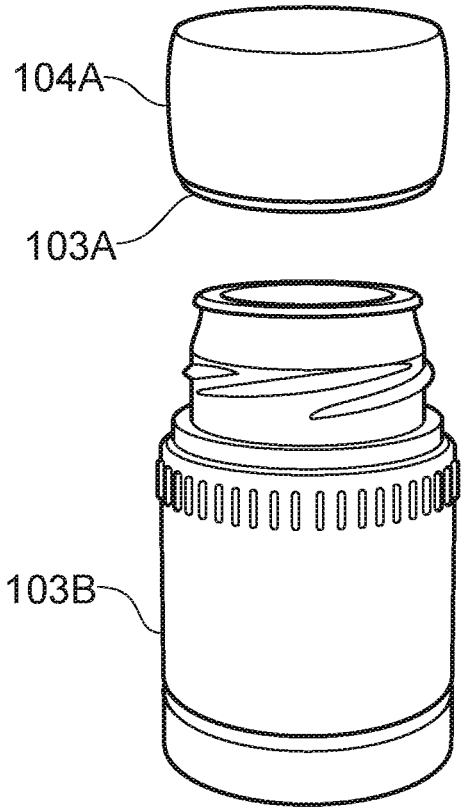
FIG. 8C is a side view of the closure of FIG. 8B with a cap removed.
Figure 8D:
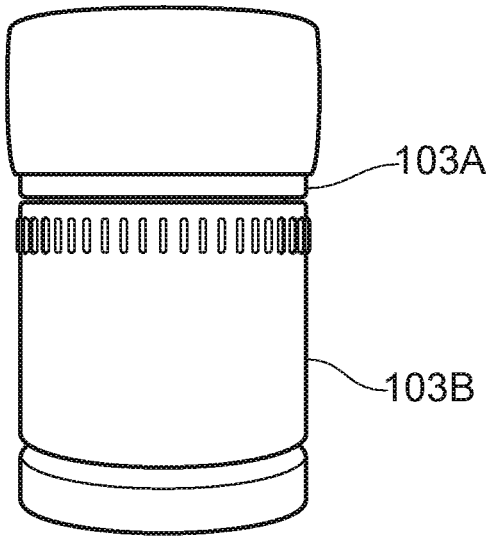
FIG. 8D is a side view of the closure of FIG. 8C with the cap replaced.
Figure 9:
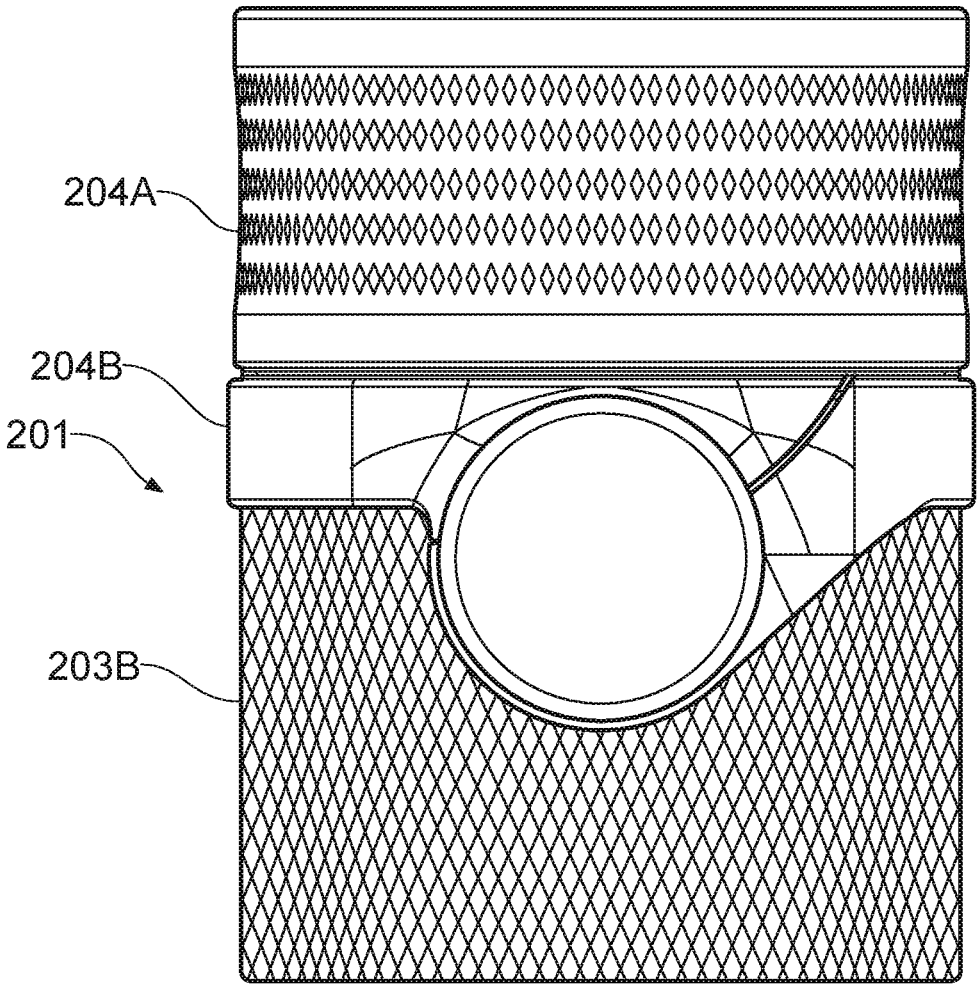
FIG. 9 is a side view of a closure formed according to an alternative embodiment and shown in a fully assembled state.

FIGS. 8A to 8C illustrate a closure 101 formed according to an alternative embodiment. The closure 100 is similar to the closure 1 except that no gap generating mechanism is provided. Therefores the member 104B is removed (FIG. 8B) and the cap/shell part 104A/103A are removed (FIG. 8C); then when the cap/shell part 104A/103A are replaced (FIG. 8D) no gap is provided between the shell parts 103A, 103B.

Referring now to FIGS. 9 to 19 there is shown a closure 201 formed according to a further embodiment and components thereof.

The closure 201 is similar to the closure 1 and comprises a shell with a removable first part 203A and a second part 203B. The closure also comprises an overcap 204 with a cap 204A and a tamper-evident member 204B. The overcap and shell have, in this embodiment, a diamond knurling pattern on their exterior surface.

Figure 10:
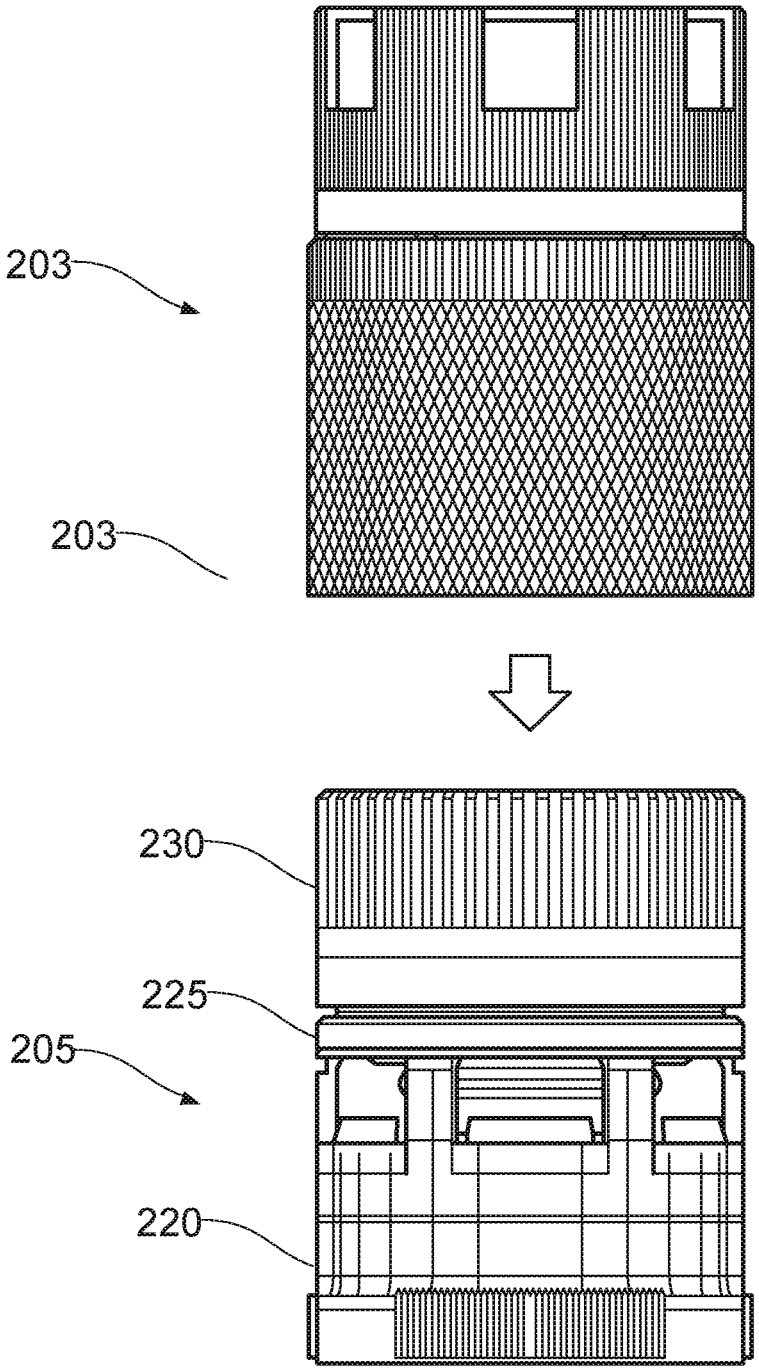
FIG. 10 shows the closure of FIG. 9 at a partially assembled stage.
Figure 14:
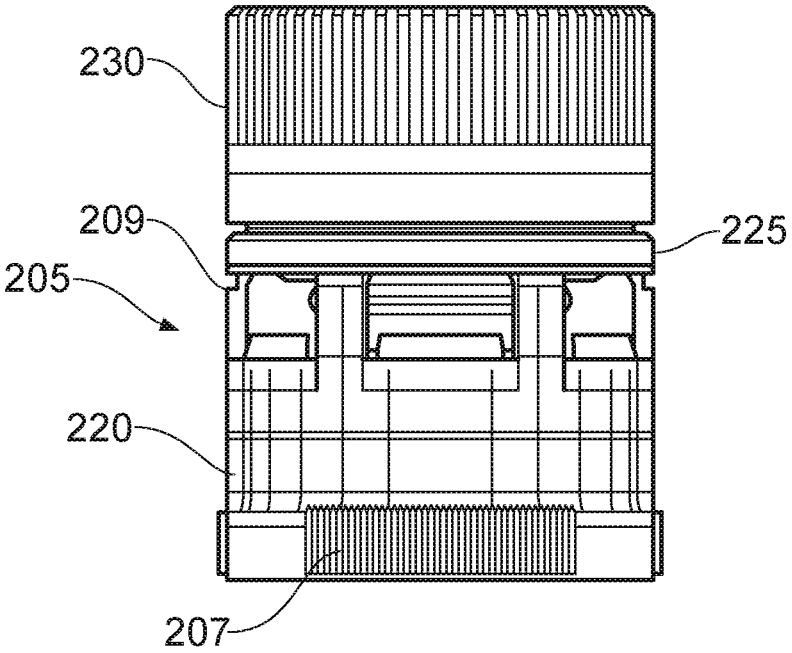
FIG. 14 is a side view of a gap generating mechanism forming part of the closure of FIG. 9.
Figure 15:
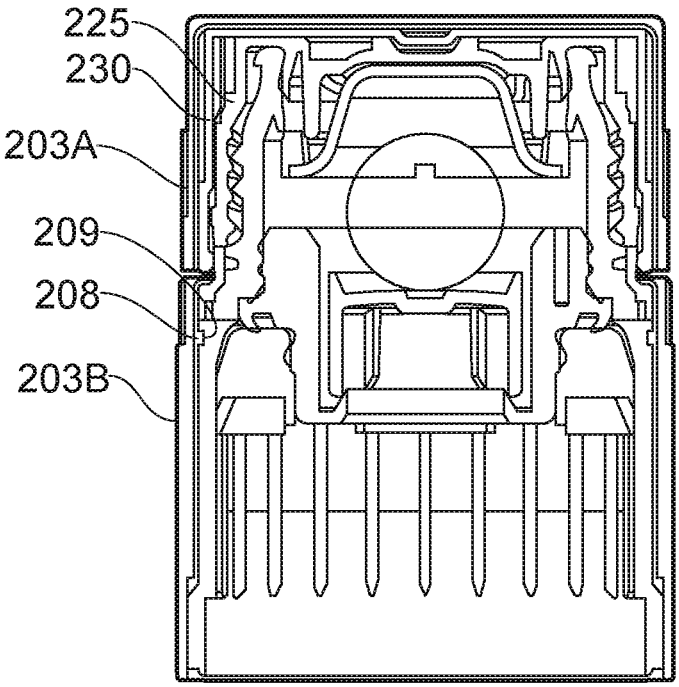
FIG. 15 is a section of the closure of FIG. 9.
Figure 16:
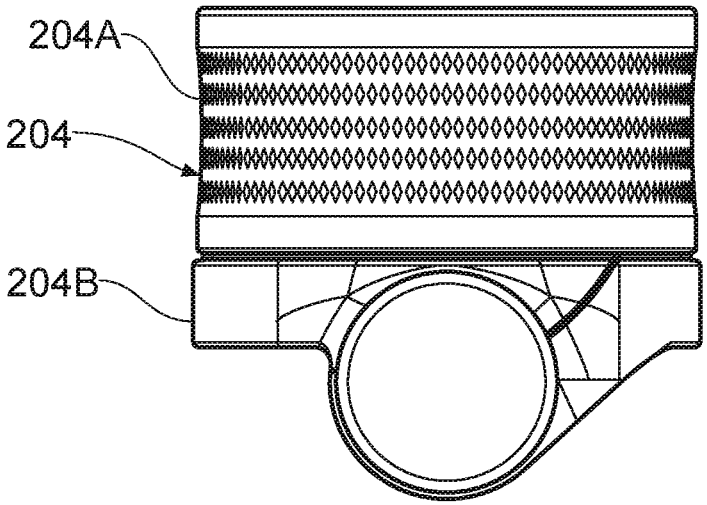
FIG. 16 is a side view of an overcap component forming part of the closure of FIG. 9.
Figure 17:
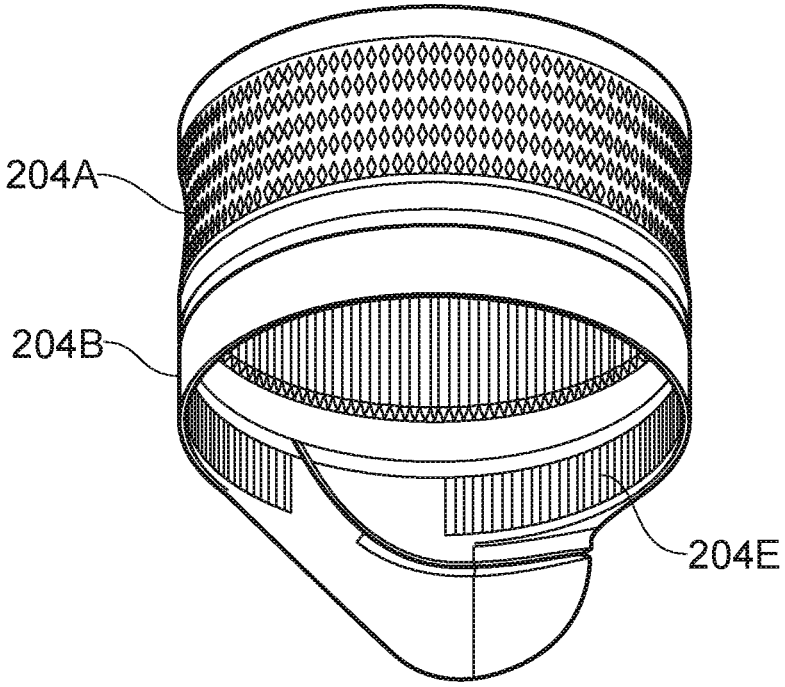
FIG. 17 is a perspective view of the overcap of FIG. 16.
Figure 18:
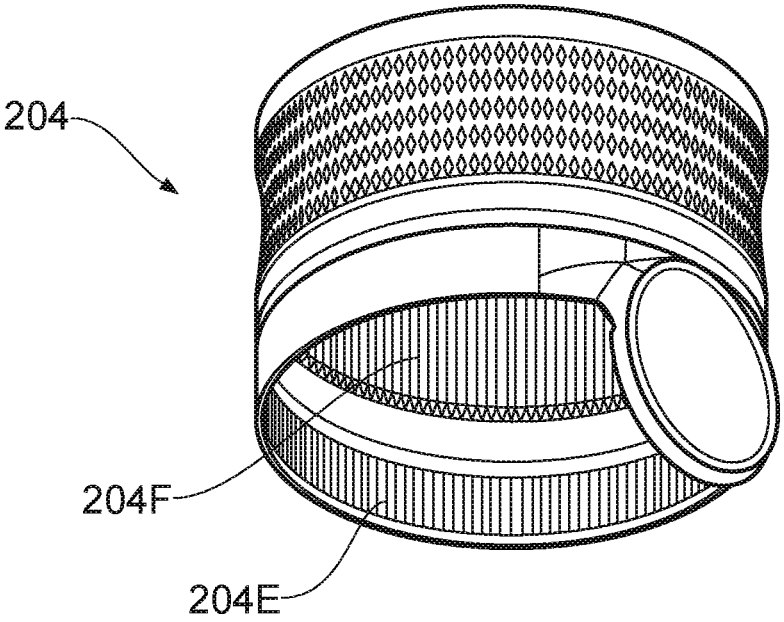
FIG. 18 is a further perspective view of the overcap of FIG. 16.
Figure 19:
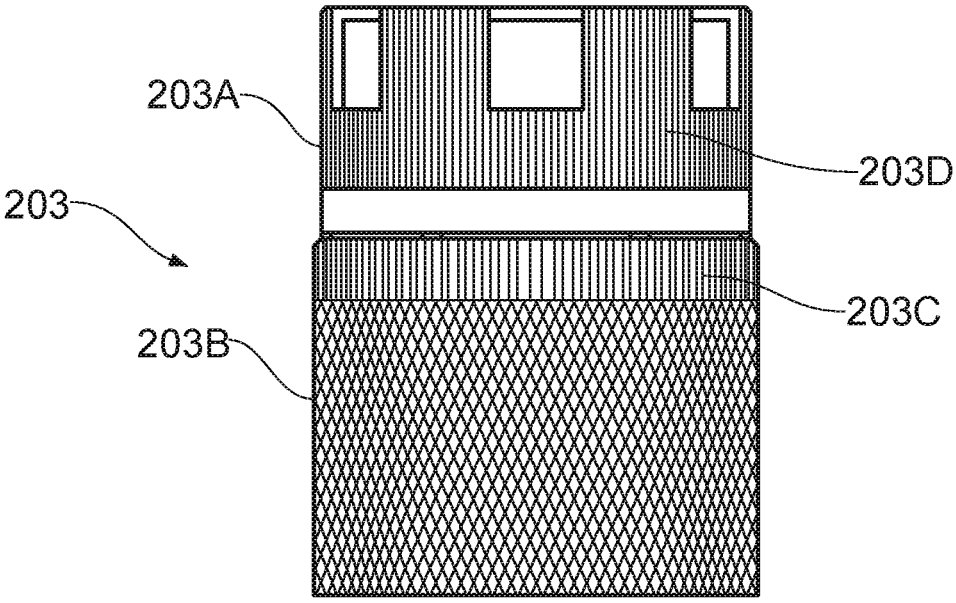
FIG. 19 is a side view of a shell component forming part of the closure of FIG. 9.

The closure 201 further comprises a gap generating mechanism 205 which fits within the shell 203 (see FIGS. 10, 14 and 15).

The open end of the shell 202 includes anti-rotation ribs 206 for engaging corresponding ribs 207 on the mechanism body. Location lugs 208 on the inner surface of the shell part 203B grip in a groove 209 formed on the mechanism body. Vertical ribs 204F on the inner surface of the cap 204A grip on to corresponding ribs 203D formed on the exterior surface of the shell part 203A. Ribs 204E on the interior surface of the band 204B engage with ribs 203C on the exterior of the shell part 2036.

Figure 11:
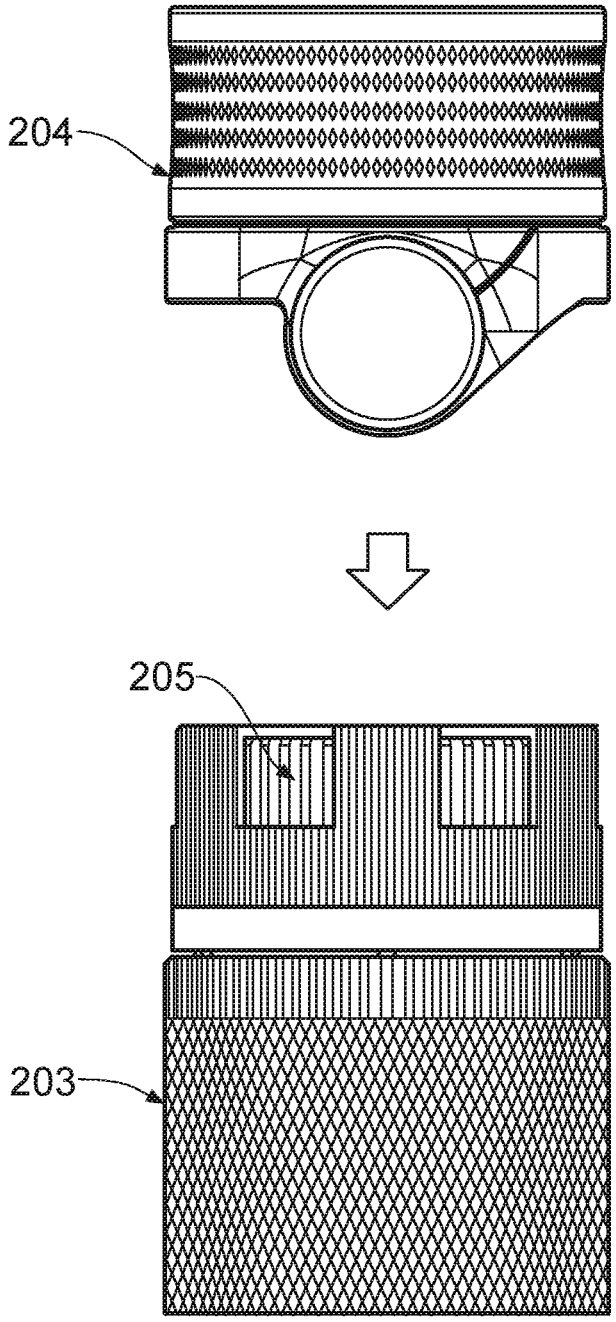
FIG. 11 shows the closure of FIG. 10 as an overcap is received to complete an assembly process.
Figure 12:
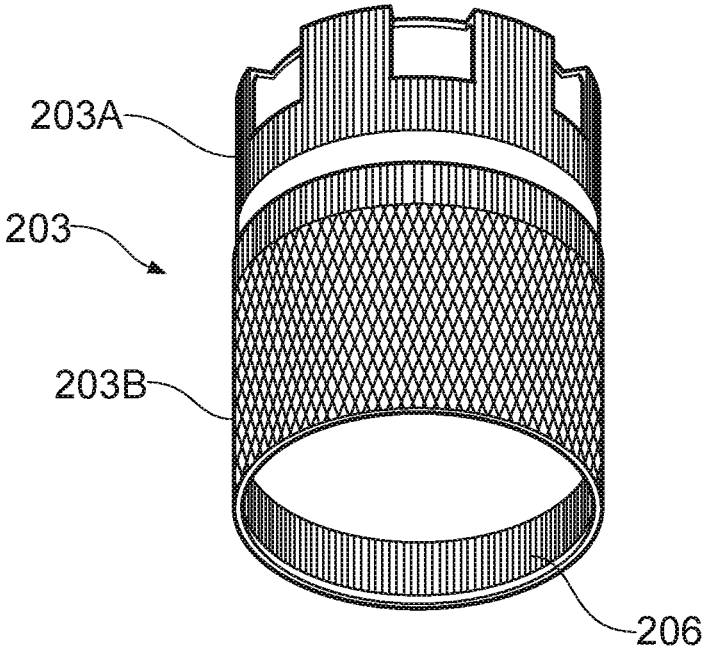
FIG. 12 is a perspective view of a shell component forming part of the closure of FIG. 9.
Figure 13:
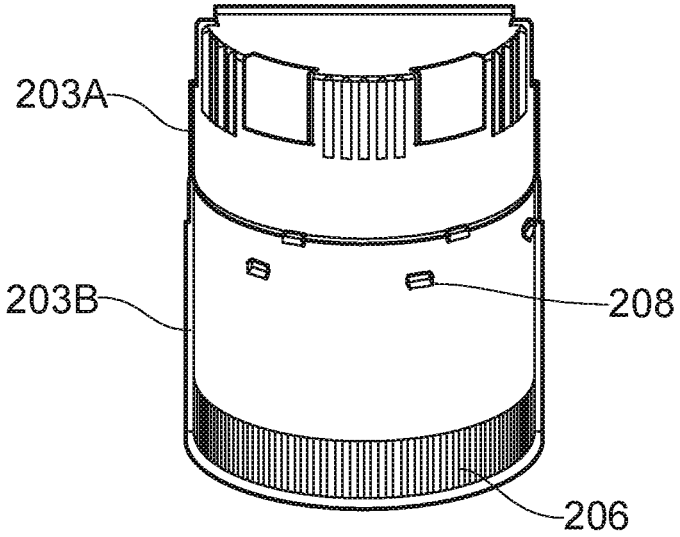
FIG. 13 is a cut-away section of the shell of FIG. 12.

The closure is assembled by fitting the shell 203 over the mechanism 205 as shown in FIG. 10. The overcap 204 is then fitted on as shown in FIG. 11.

The mode of operation of the closure 201 is generally the same as for the closure 1.

Figure 20:
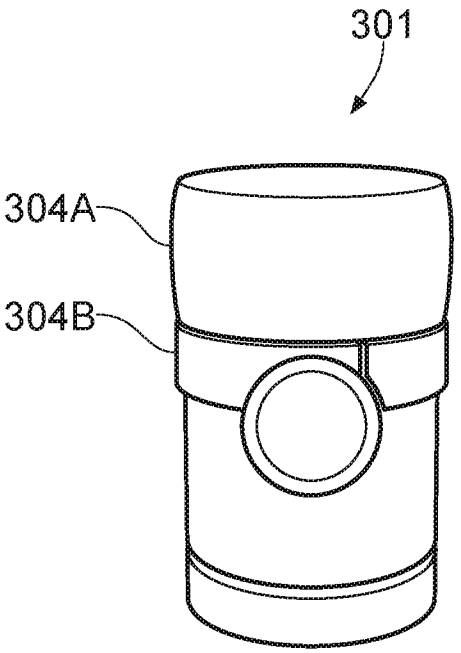
FIG. 20 shows a closure formed according to an alternative embodiment and fitted to a container neck.
Figure 21:
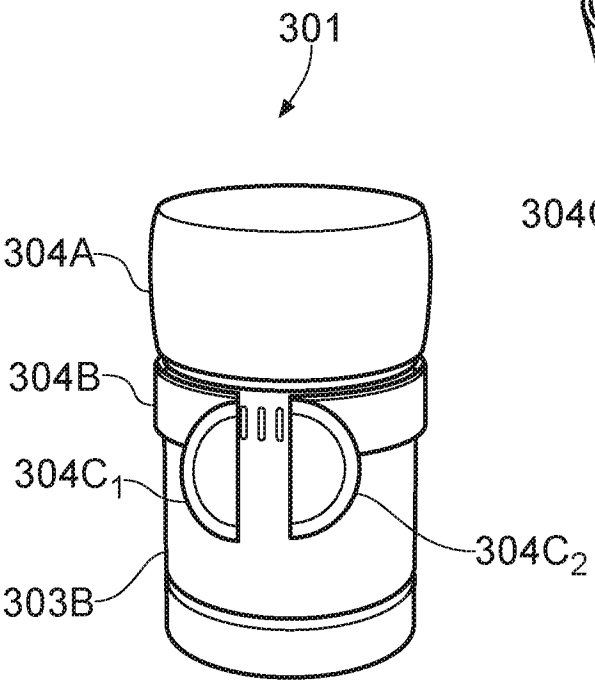
FIG. 21 shows the closure of FIG. 20 with a tamper-evident member partly removed.
Figure 22:
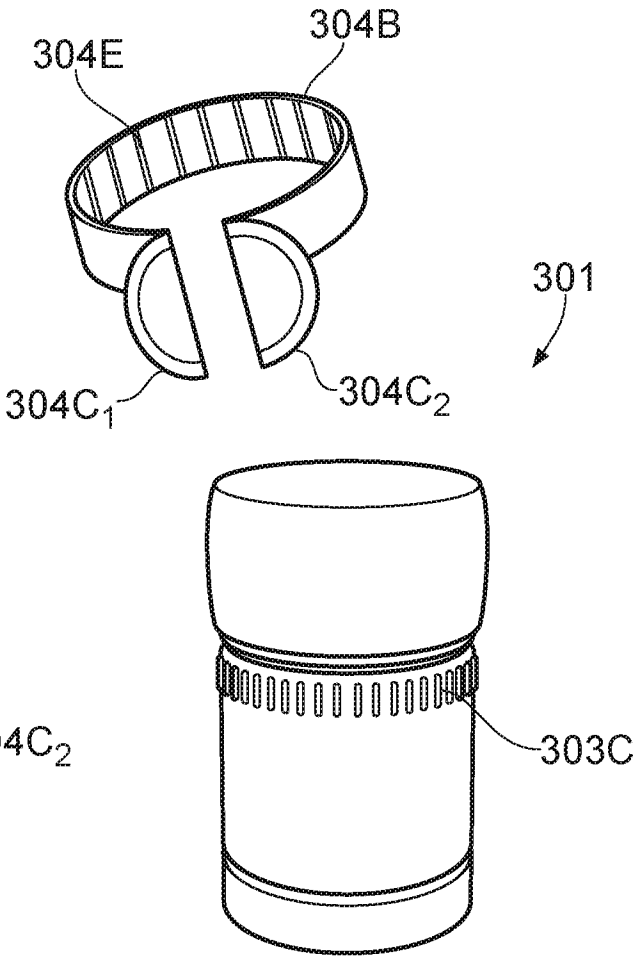
FIG. 22 shows the closure of FIG. 21 with the tamper-evident member fully removed.

In FIGS. 20 to 22 a closure 301 formed according to an alternative embodiment is shown. The closure 301 is similar to the closure 1, except that the seal 304C has a frangible line which causes it to be broken in half as shown in FIG. 21 (304C broken into halves 304C1 and 304C2). The functioning of the closure is otherwise the same. FIG. 22 also shows co-operating ribs 303C, 304E on the exterior of the shell part 303B and the interior of the band 304B.

There now follows a description of some gap generating mechanisms which could be used together with the tamper-evident overcap of the present invention.

Figure 23:
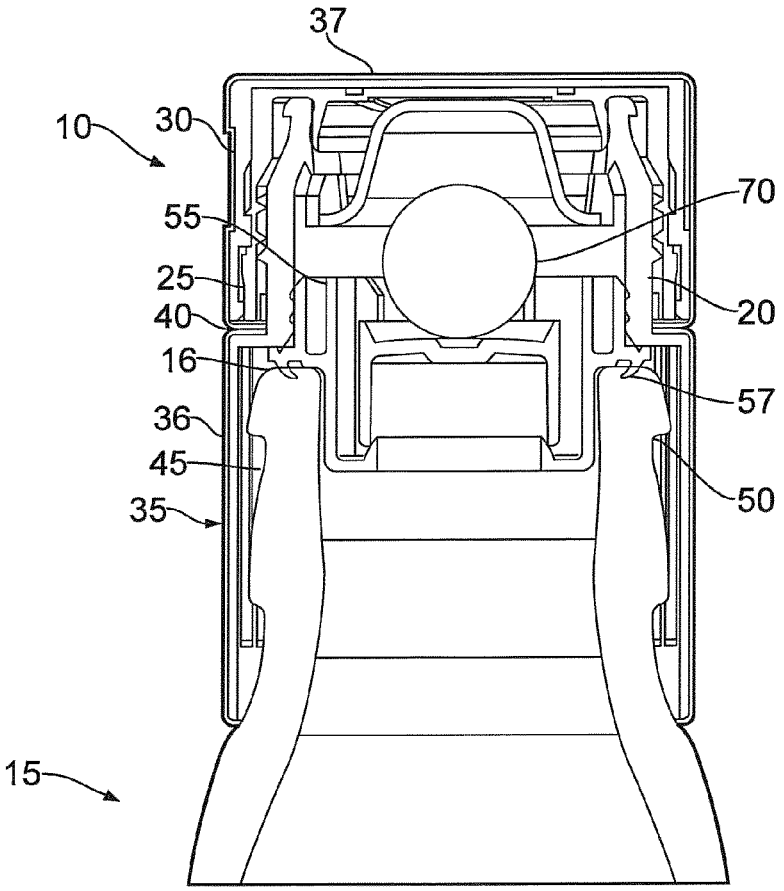
FIG. 23 is a section of a closure illustrating a gap forming mechanism suitable for use in conjunction with the present invention in a first, unopened position.
Figure 24:
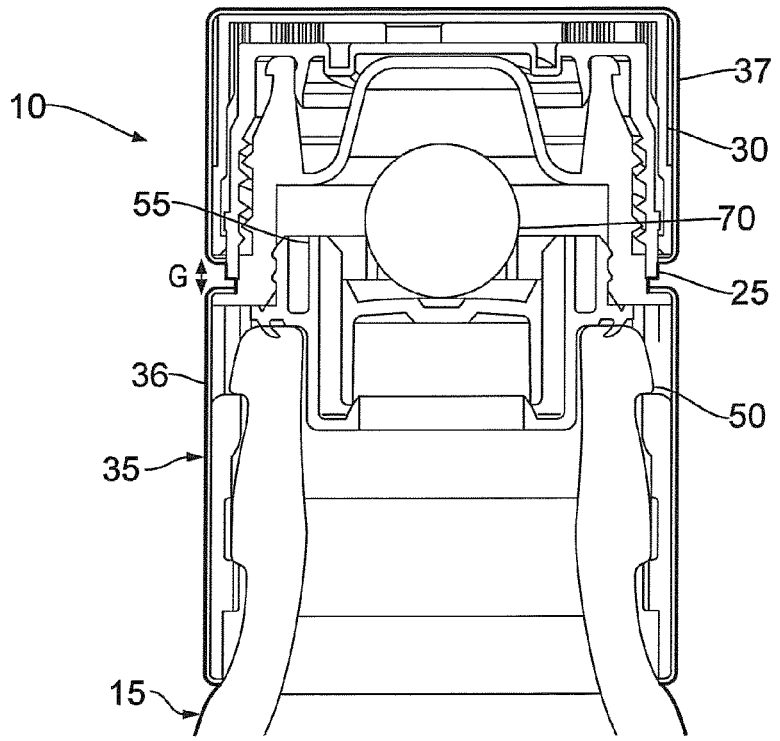
FIG. 24 is a section of the closure of FIG. 23 shown in a second, opened position.
Figure 25:
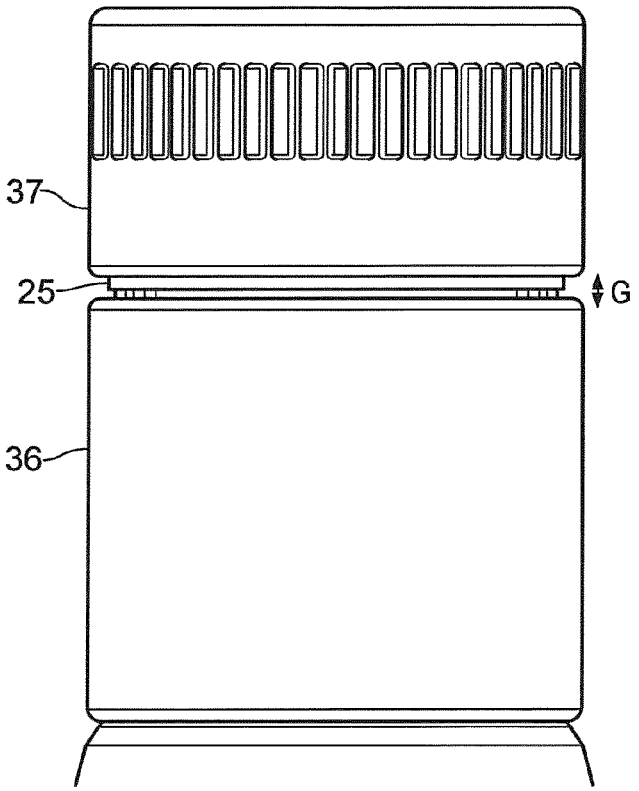
FIG. 25 is a side elevation of the opened closure shown in FIG. 24.

Referring to FIG. 23 there is shown a closure generally indicated 10 secured onto a container neck 15.

The closure 10 comprises a main body 20, an inner part 25 and an outer part 30. A metal shell 35 forms an outer casing to the closure and is divided into a cylindrical lower part 36 and a cup-shape second part 37. The parts 36, 37 are separated at a split line 40 formed by a cutting process once the shell 35 has been applied to the first and second portions of the closure.

Together the body 20 and the shell part 36 comprise a second portion and the inner and outer parts plus the shell part 37 comprises a cap-like first portion.

The main body 20 is fixed onto the container neck 15 by clips 45 which project inwardly and engage under a shoulder 50.

A valve housing 55 is clipped into the main body 20 and includes a sealing lip 57 which seals against the top surface 16 of the container neck 15.

A float valve 65 is housed in the housing 55 and can seal against a valve seat 60 to prevent re-filling of the container. A valve control ball 70 is located on top of the float valve 65.

In use, the second part 37 of the shell 35 is rotated. This unscrews the outer part 30 from the inner part 25. The outer part unscrews until a locking mechanism described in more detail below locks it to the inner part 25. With the outer and inner parts locked together the inner part 25 can then be unscrewed from the main body 20.

When the cap (shell part 37/outer part 30/inner part 25) is screwed back onto the main body 20, a gap G is formed between the first and second shell parts 36, 37. This is because the outer part 30 cannot be screwed completely back down onto the inner part 25 by virtue of the locking mechanism. In addition, the bottom of the inner part 25 protrudes below the bottom of the outer part 30 so as to be visible in the gap G.

The gap G formed between the shell parts 36, 37 is unobstructed in the sense that there is no obstruction member trapped between the parts 36, 37.

Figure 26:
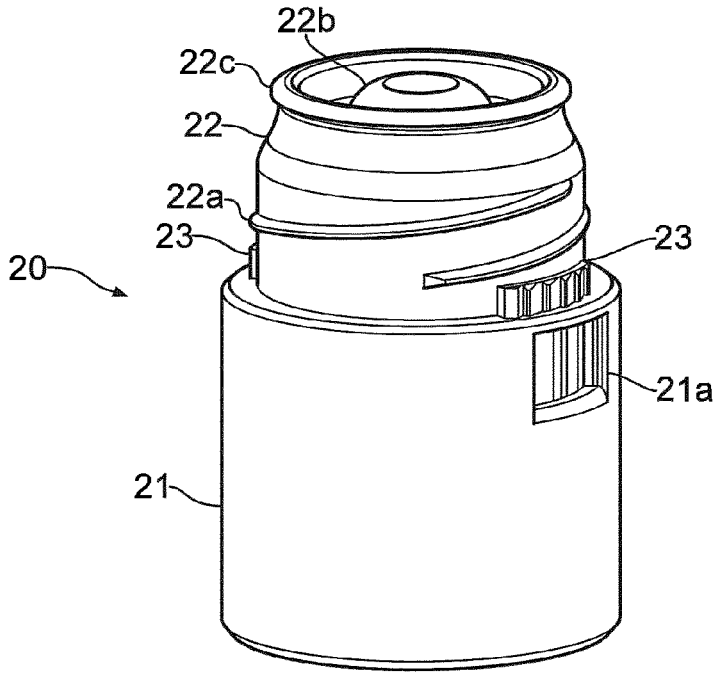
FIG. 26 is a perspective view of a second portion of the closure.
Figure 27:
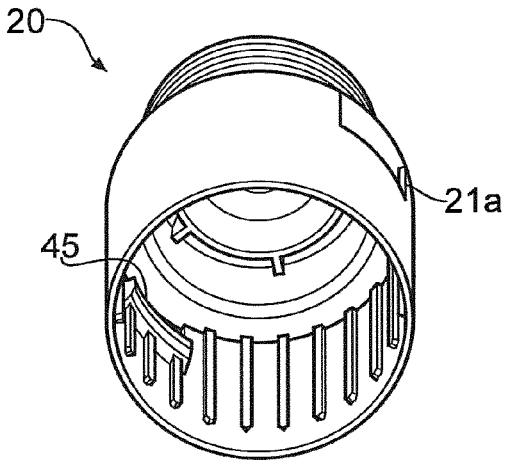
FIG. 27 is an underside perspective view of the second portion shown in FIG. 26.

Referring now to FIGS. 26 and 27 the main body 20 is shown in more detail.

The body 20 comprises a lower engagement portion 21 and an upper flow regulation portion 22.

The lower portion 21 comprises a generally cylindrical body having two diametrically opposed windows 21*a* each of which has at a lower edge a ledge 45 for engagement under the container neck shoulder 50 as shown in FIGS. 1 and 2. In addition, the interior surface of the lower portion 21*a* has a plurality of mutually spaced axial ribs 21*b* which lock onto the outer surface of the container neck in use to prevent relative rotation between the container neck and the body 20.

The upper portion 22 of the main body 20 is generally frusto-conical in shape and has external screw threads 22*a*. At the base of the portion 22 where it joins the portion 21, two sets of ratchet teeth 23 are positioned. The teeth 23 engage corresponding teeth on the inner part 25 to prevent it from rotating whilst the outer part 30 is being rotated for the first time in use. Only after the outer part 30 has locked against the inner part 25 can the inner part 25 be rotated relative to the body 20. At the opposite end of the portion 22 a dome-shape flow regulator 22*b* is positioned in the aperture. The aperture itself is defined by a circumferential pouring lip 22*c*.

Figure 28:
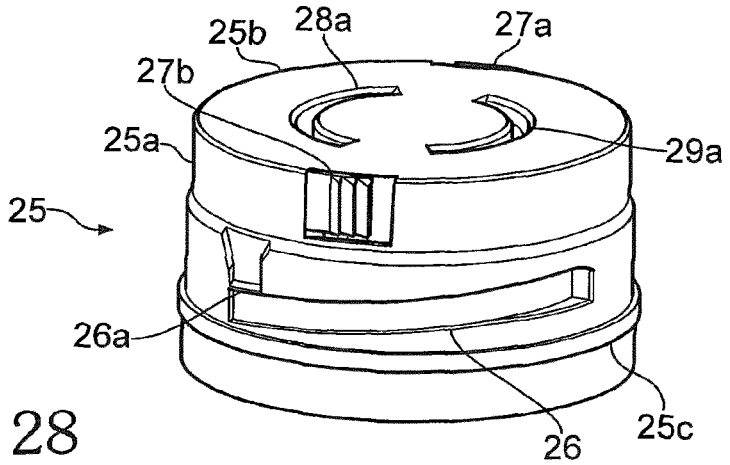
FIG. 28 is a perspective view of a first portion inner part of the closure.
Figure 29:
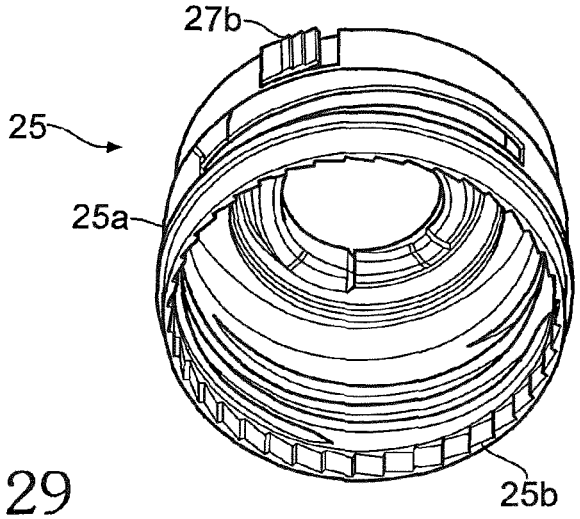
FIG. 29 is an underside perspective view of the inner part of FIG. 28.
Figure 30:
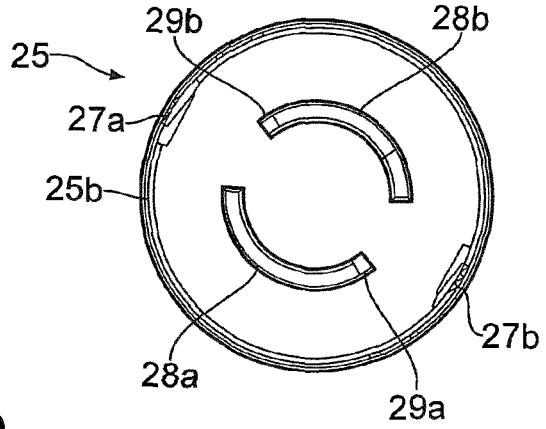
FIG. 30 is a plan view of the inner part shown in FIG. 28.

Referring now to FIGS. 28 to 30 the inner part 25 is shown in more detail.

The inner part 25 is generally cup-shape with a cylindrical side wall 25*a* closed at one end by a top plate 25*b*.

The interior surface of the open end of the sidewall 25*a* includes a continuous series of ratchet teeth 25*b* which engage the ratchets 23 on the main body portion 22.

The exterior of the sidewall 25*a* includes two inclined side ramps 26. At the start of each ramp 26 is a locking step 26*a* the purpose of which will be described in more detail below.

The sidewall 25*a* also comprises a pair of ratchet members 27*a*, 27*b* adjacent the top plate 25*b*.

The exterior surface of the sidewall 25*a* also comprises a circumferential bead 25*c* the purpose of which will be described in more detail below.

The top plate 25*b* comprises a pair of opposing arcuate ramps 28*a*, 28*b* each of which terminates with a locking recess 29*a*, 29*b*.

Figure 31:
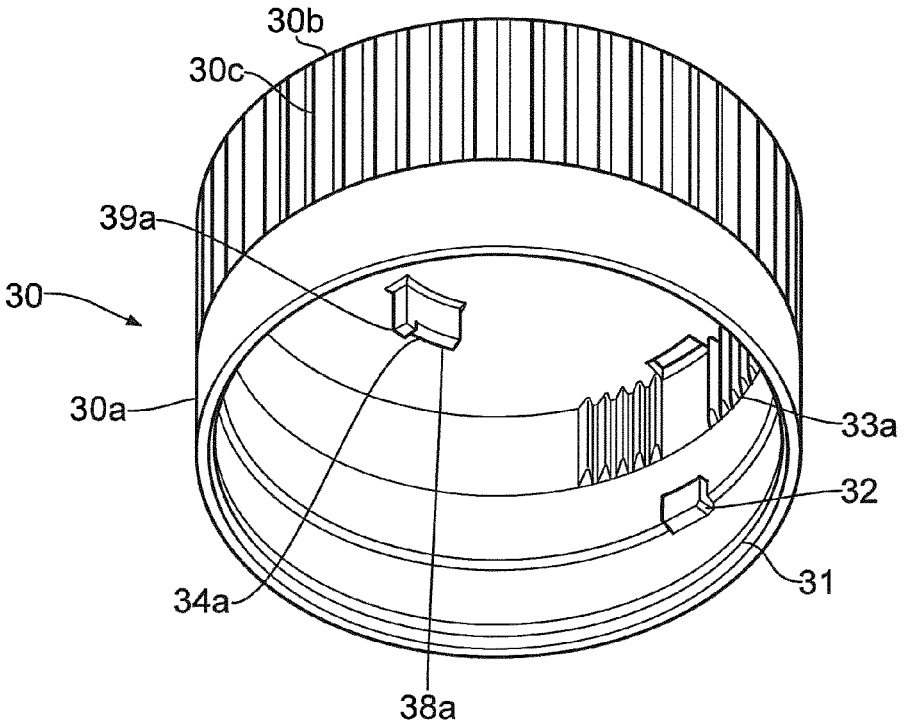
FIG. 31 is an underside perspective view of a first portion outer part of the closure.
Figure 32:
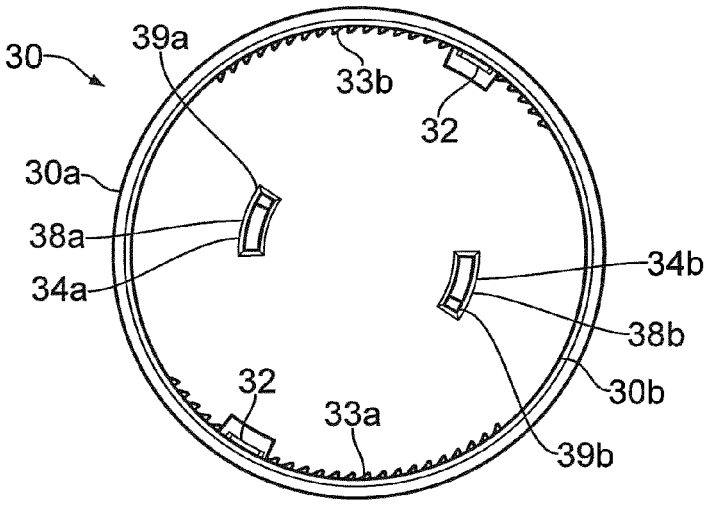
FIG. 32 is an under planned view of the outer part of FIG. 31.

Referring now to FIGS. 31 and 32 the outer part 30 is shown in more detail.

The part 30 is generally cup-shape and comprises a cylindrical side wall 30*a* and a top plate 30*b*.

The exterior of the part 30 comprises a plurality of knurls 30*c* which help to lock the shell part 37 and to prevent relative rotation.

The interior of the sidewall 30*a* comprises a circumferential bead 31 for preventing the outer part 30 being lifted off the inner part by engagement with the corresponding bead 25*c*.

The interior of the sidewall 30*a* also comprises a pair of drive dogs 32 which engage in the ramps 26 of the inner part 25 and ride up them as the outer part 30 is rotated relative to the inner part 25.

The interior of the side wall 38 also comprises a pair of diametrically opposed ratchet arrangements 33*a*, 33*b* designed and positioned to run over and lock onto the corresponding ratchet arrangements 27*a*, 27*b* on the inner part 25 to prevent counter rotation.

The underside of the top plate 30*b* includes a pair of drive dogs 34*a*, 34*b* each of which comprises a main body 38*a*, 38*b* and a locking tooth 39*a*, 39*b*.

Figure 33:
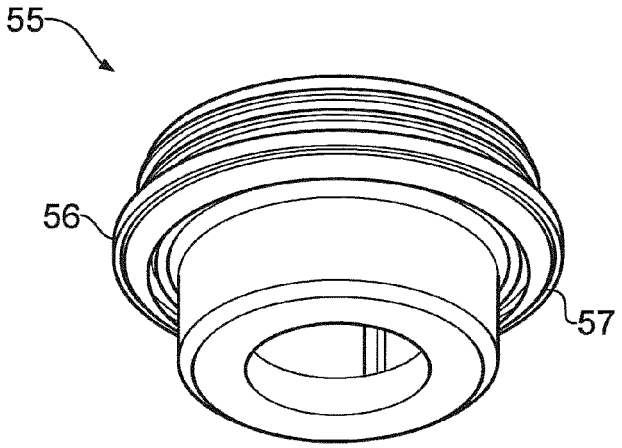
FIG. 33 is a perspective view of a valve housing forming part of the closure.
Figure 34:
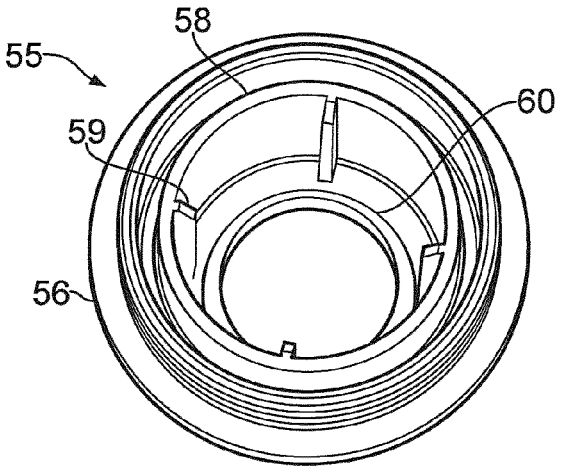
FIG. 34 is a further perspective view of the valve housing of FIG. 33.

Referring now to FIGS. 33 and 34 a valve housing 55 is shown in more detail.

The housing 55 comprises a generally cylindrical body having a circumferential sealing flange 56 with a depending sealing lip 57 (sometimes referred to as a "crabs claw").

The exterior of the housing includes two circumferential beads 61, 62 which are used to clip the housing into the body 20 (as shown in FIG. 1).

The interior of the housing 55 comprises a valve chamber 58 having four locating ribs 59 and a valve seat 60.

Figure 35:
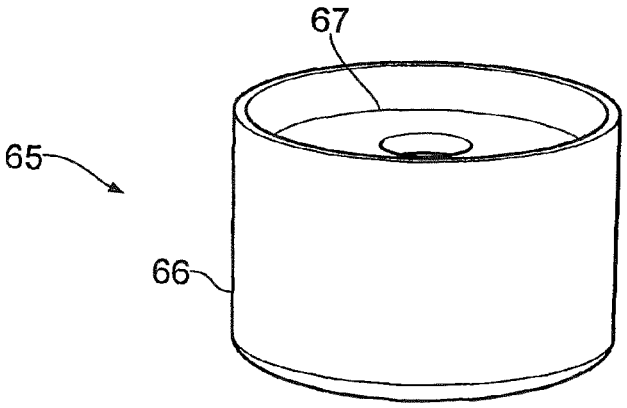
FIG. 35 is a perspective view of a valve member forming part of the closure.
Figure 36:
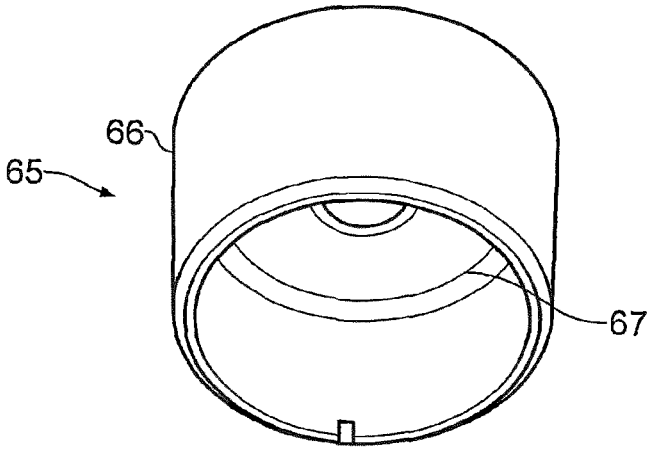
FIG. 36 is a further perspective view of the valve member of FIG. 8A.

Referring now to FIGS. 35 and 36 a float valve 65 is shown in more detail.

The valve 65 comprises a generally cup-shape body comprising a cylindrical side wall 66 and a recessed top plate 67.

The operation of the closure will now be described in more detail.

Initially the body 20 is locked on to the neck 15 by the ribs 21*b* to prevent axial and rotational movement. The inner part 25 cannot rotate relative to the body 20 by virtue of the ratchets 23, 25*b*. The shell part 37 cannot rotate relative to the outer part by virtue of the knurls 30*c*. The outer part 30 cannot be lifted off the inner part 25 by virtue of the locking beads 25*c*, 31 and by virtue of the drive dogs 32 engaging under the steps 26*a*

The shell part 37 is grasped by a user and turned. This causes the outer part 30 to rotate relative to the inner part 25. The drive dogs 32 in the outer part rise up the ramps 26 in the inner part and the drive dogs 34*a* rise up the ramps 28*a*, 29*a*. The ratchets 33*a* pass over the ratchets 27*a*, 27*b*.

The outer part is caused to rise by 2 mm. At this point continued rotation causes the locking teeth 39*a*, 39*b* to drop into the locking recesses 29*a*, 29*b*. In addition, the ratchets 33*a* have rotated beyond the ratchets 27*a*, 27*b*. The inner part drops back down by 0.5 mm.

Continued rotation of the outer part relative to the inner part is not possible because the drive dogs 32 abut against the end of the ramps 26 and the drive dogs 34*a*, 34*b* abut against the end of the ramps 28*a*, 28*b*.

In this second position the open end of the outer part 30 has moved axially away from the open end of the inner part 25 to expose the free end of the sidewall 25*a*.

Continued rotation of the cap part (the shell part 37, the outer part 30 and the inner part 25) overcomes the torque required to allow the ratchets 25 to pass over the ratchets 23 which causes the inner part to rotate relative to the body. The internal screw threads 25*d* on the inner part rise up the external screw threads 22*a* of the body.

The cap part can now be lifted off the body 20 to allow the contents of the container to be dispensed.

The contents are dispensed through the valve housing 55. The valve 65 lifts off the seat 60 as the container is upturned and contents flow out. The valve 65 re-seals against the seat 60 under the weight of the ball 70 when the container is returned to an upright position. This prevents re-filling of the container.

When the cap part is returned the inner part 25 is screwed back onto the body 20. The inner part screws back down to its original position, but the outer part cannot because it is locked in position both by the axial locking means provided by the drive dogs 34*a*, 34*b* and the lateral locking means provided by the ratchets 33*a*, 33*b* and 27*a*, 27*b*. This means that the gap G is formed between the shell parts 36, 37 with free end of the inner part skirt visible through it. This irreversible opening event provides visual evidence that the closure has been opened at least once. The gap G cannot be closed without destroying the closure.

Because the gap G between the metal shell parts 36, 37 is not generated by placing an obstruction directly between them, it is not possible to close the gap G by a simple cutting operation.

By providing the dual axial and lateral ratchet arrangements, re-setting closure back to its original position to close the gap G is prevented. In an alternative embodiment (not shown) a similar closure is provided with just an axial ratchet arrangement.

Figure 38:
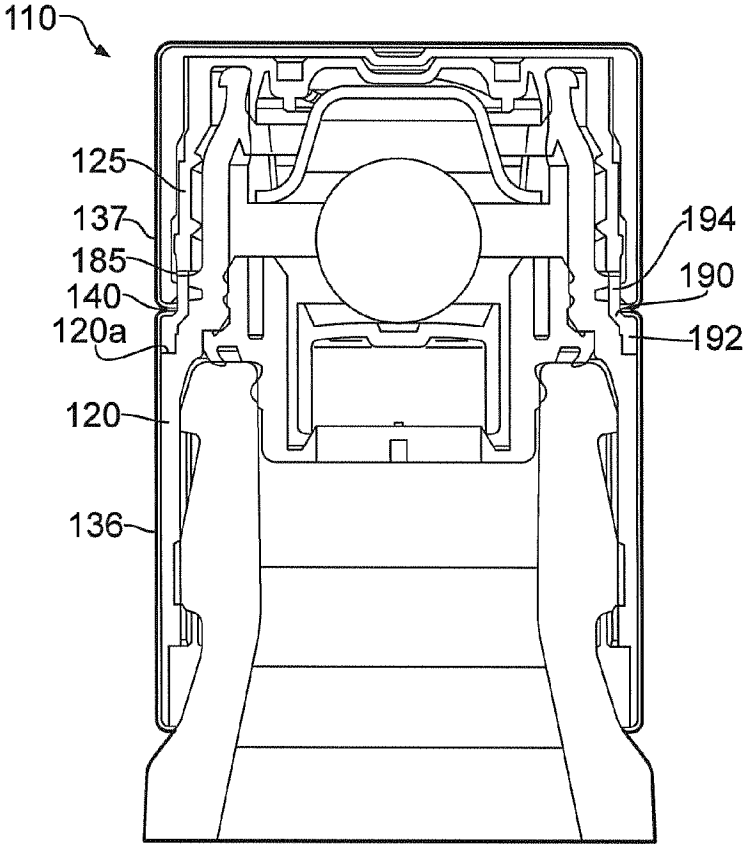
FIG. 38 is a section of the closure shown in FIG. 37.
Figure 37:
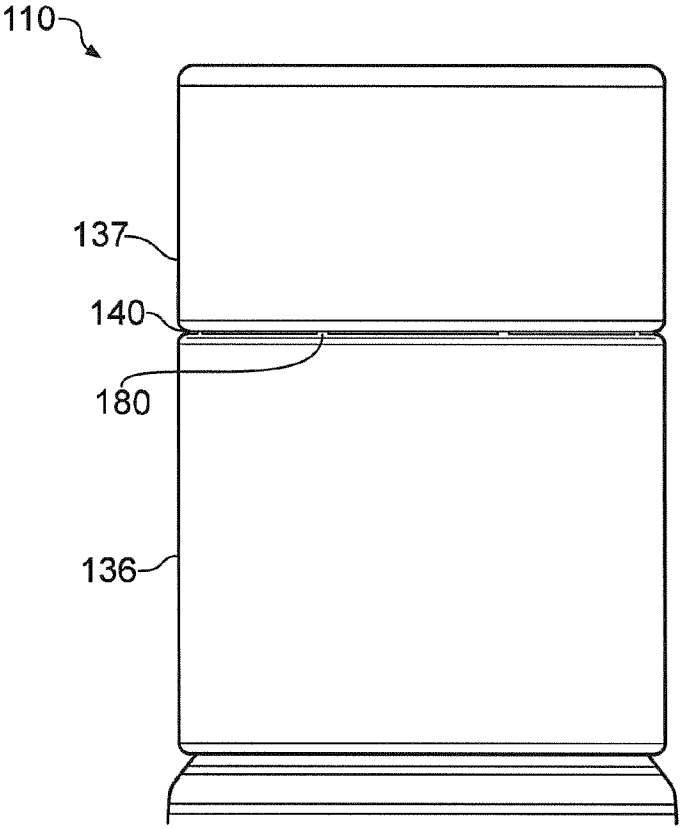
FIG. 37 is a side elevation of a closure formed according to an alternative embodiment and also illustrating a gap generating mechanism suitable for use in the present invention.
Figures 39, 40, 41, 42:
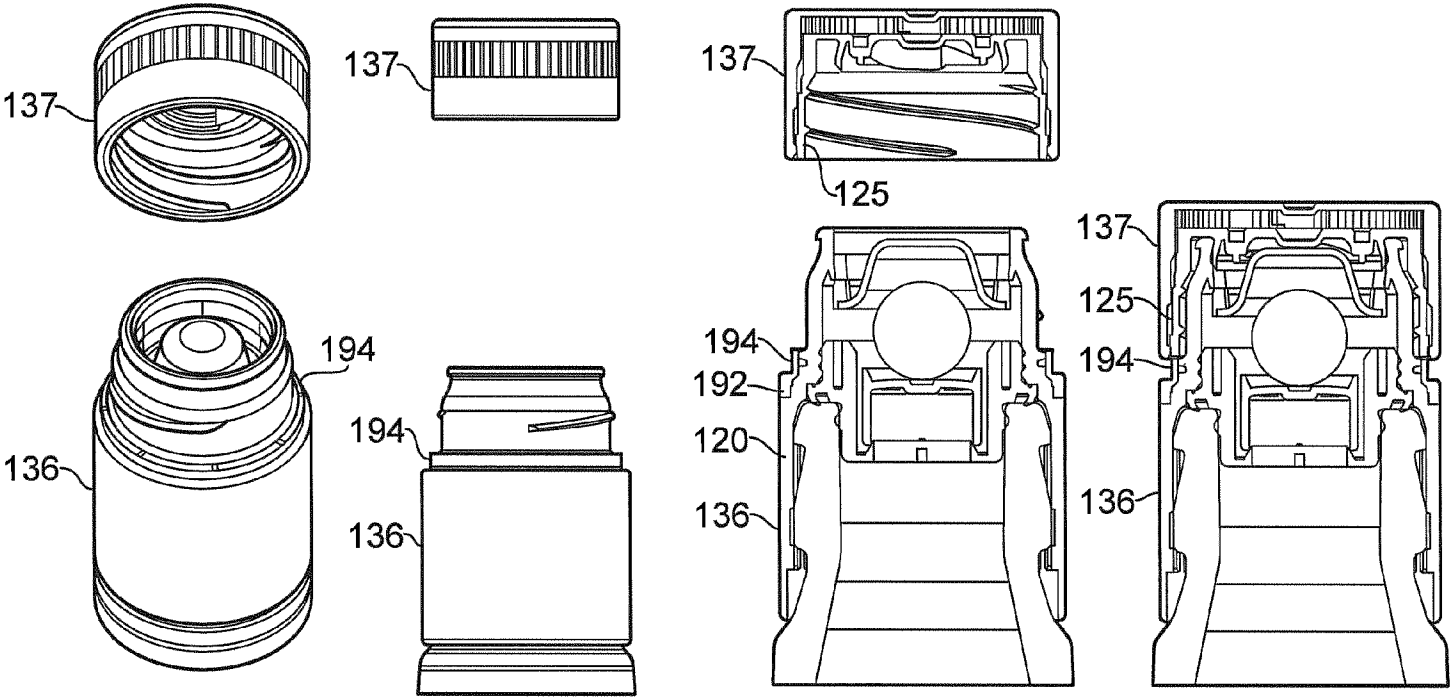
FIG. 39 is a perspective view of the closure of FIGS. 37 and 38 shown in an open position.
FIG. 40 is a side elevation of the closure of FIG. 39.
FIG. 41 is a section of the closure shown in FIG. 40.
FIG. 42 is a section of the closure shown in FIGS. 37 to 41 shown in a closed position following an initial irreversible opening event.
Figures 43, 44, 45, 46:
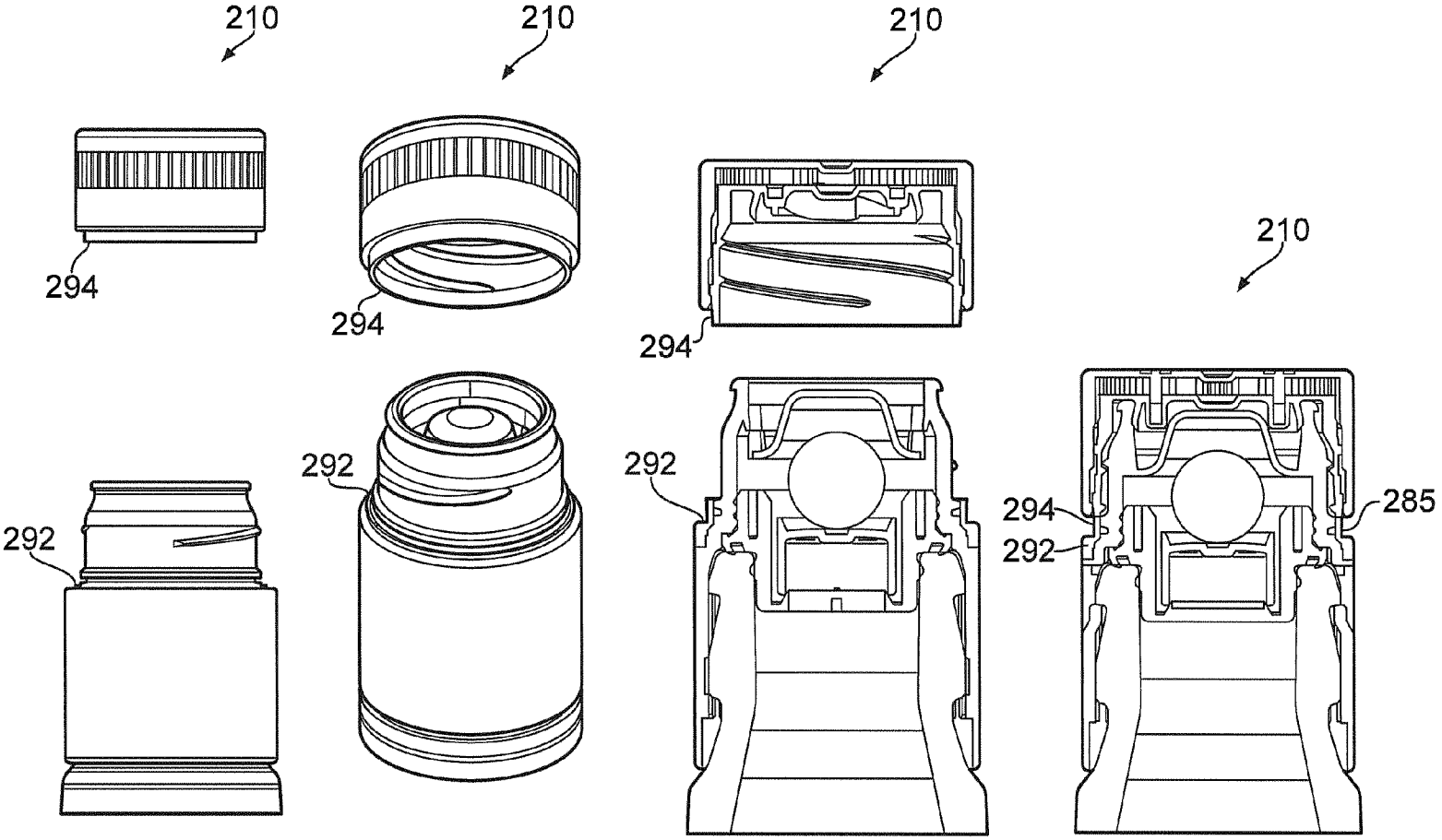
FIG. 43 is a side elevation of a closure having a further gap generating mechanism and shown in an open position.
FIG. 44 is a perspective view of the closure shown in FIG. 43.
FIG. 45 is a section of the closure shown in FIGS. 43 and 44.
FIG. 46 is a section of the closure shown in FIGS. 43 to 45 shown in a closed position following an initial irreversible opening event.

Referring now to FIGS. 37 and 38 there is shown a closure 110 formed according to an alternative embodiment. The closure 110 is similar to the closure 10 illustrated in FIGS. 23 to 36.

In this embodiment the upper and lower shell parts 136, 137 are initially joined by a plurality of frangible bridges 180 which will break if either: i) the lower shell part 136 is rotated before initial opening; or ii) an attempt is made to pull the top part of the closure off without unscrewing. The bridges therefore serve as an additional tamper-evident feature.

As seen best in FIG. 38, the inner part 125 of the closure extends beyond the split line 140 and the open end of the outer part to provide a dog-leg shape terminal portion 190 which rests on a shoulder 120*a* on the main body 120 so that one half 192 of the terminal portion fits beneath the upper end of the lower shell part 136 and the other half 194 fits in the upper shell part 137. Above the shell split line 140 a plurality of frangible bridges (not shown) are formed in the inner part 125 to form a split line 185.

Referring now to FIGS. 39 to 42, in use, when the closure is opened the shell part 137 is unscrewed in the same way as that described for the closure 10. In this embodiment, however, the unscrewing action breaks both the bridges 180 on the split line 140 and those on the split line 185. The result is that the terminal portion 190 of the inner part remains held on the body so that the half 194 produces a visible upstanding band. When the top cap is replaced, as shown in FIG. 14, the band 194 is visible through the gap G.

FIGS. 43 to 49 show a closure 210 formed according to an alternative embodiment. The closure is very similar to the closure 110 and includes an extended inner part 225 which has a dog-leg shape terminal portion 290. In this embodiment a split line 285 is formed approximately in line with the split line 240 between the shell parts. The result is that in use instead of a band being retained on the lower part of the closure, the upper half 294 of the terminal portion 290 is removed with the top cap on first opening and projects below the open end of the cap so as to be clearly visible. When the closure is then returned to the closed position (FIG. 46) the portion half 294 is visible in the gap G.

Figure 49:
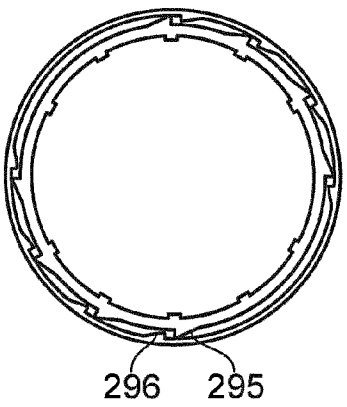
FIG. 49 is a plan view of the closure body/end portion shown in FIG. 48.
Figure 48:
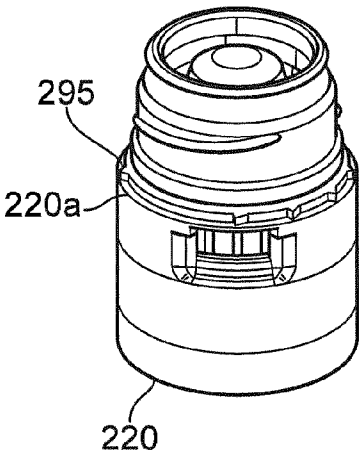
FIG. 48 is a perspective view of the closure body shown in FIG. 47.
Figure 47:
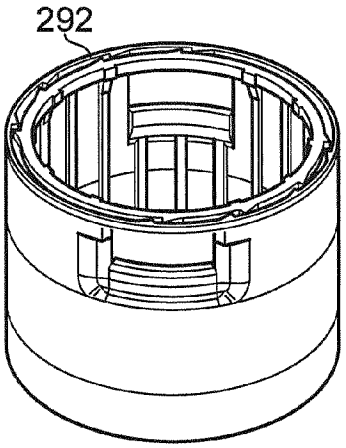
FIG. 47 is a perspective view of part of a closure body forming part of the closure shown in FIGS. 43 to 46 illustrating connection of an inner part terminal end portion.

As shown best in FIGS. 47 to 49, the terminal portion half 292 sits on the body shoulder 220*a*. The body wall extending from the shoulder 220*a* carries a plurality of ratchet teeth 295 for engaging a plurality of corresponding teeth 296 formed on the interior surface of the half 292. This prevents the half rotating relative to the body 220 in use and ensures breakage of the bridges formed along the split line 285. A similar arrangement is provided for the closure 110.

Figure 50:
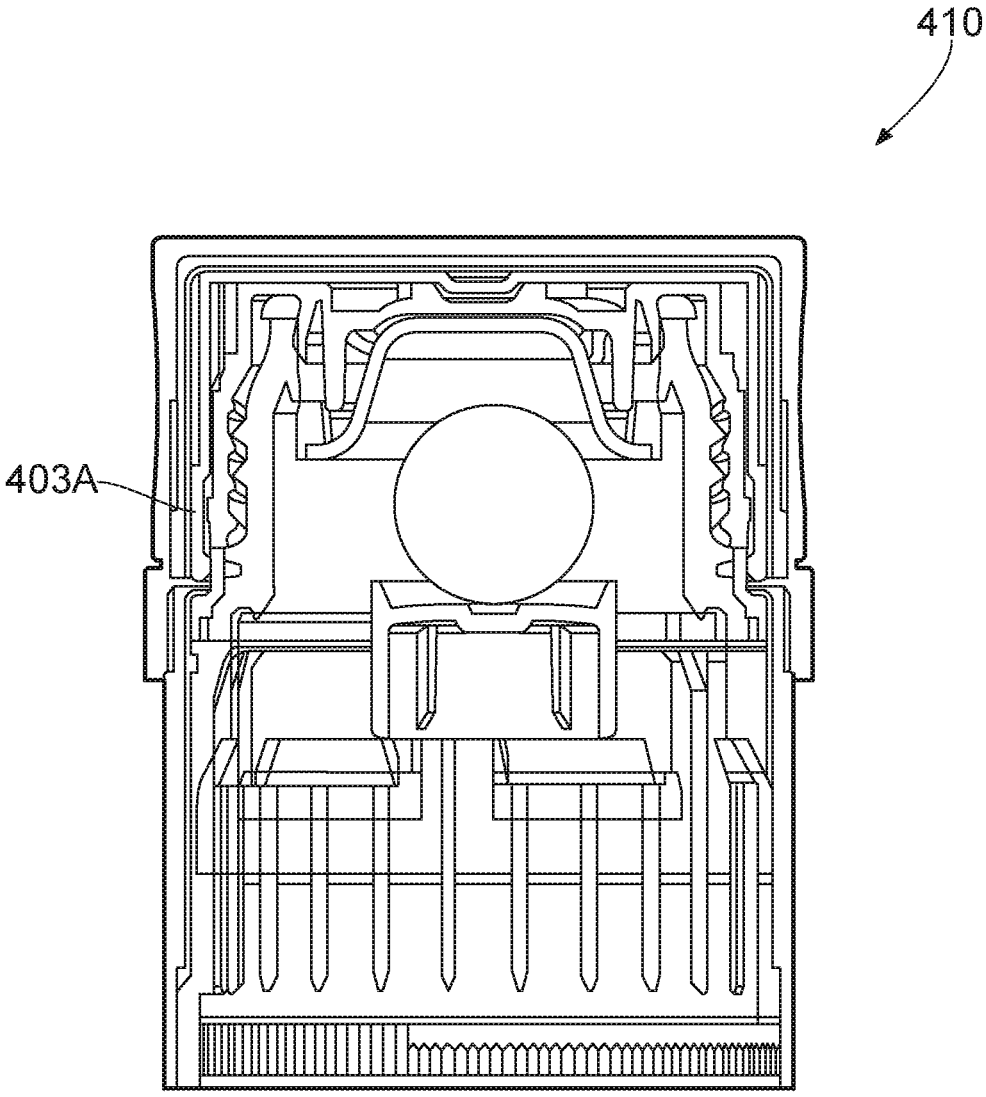
FIG. 50 is a section of a closure formed according to a further embodiment.
Figure 51:
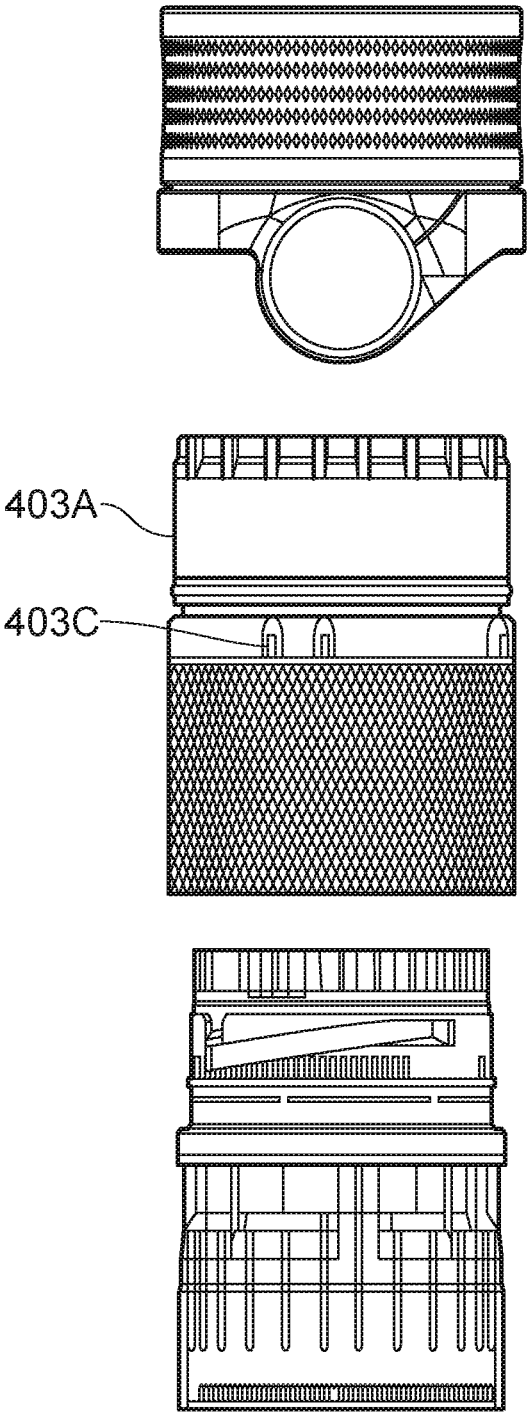
FIG. 51 is an exploded view of the closure of FIG. 50.

In FIGS. 50 and 51 a closure 410 formed according to a further embodiment is shown.

The closure is very similar to the closure 210 of FIGS. 9 to 19 except that the sleeve upper part (203A) and the outer ratchet part (225) are combined into one component 403A. In other words the upper part of the sleeve 403A also carries the functionality of the outer ratchet part. The functionality of the closure 410 is unchanged.

The description and drawings merely illustrate the principles of the invention. It will thus be appreciated that those skilled in the art will be able to devise various arrangements that, although not explicitly described or shown herein, embody the principles of the invention. Furthermore, all examples recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A tamper-evident closure for a container, the tamper-evident closure comprising:

a shell comprising a first shell part and a second shell part, and a tamper-evident overcap comprising a cap and a tamper-evident member releasably connected to the cap by a releasable connection therebetween;

the tamper-evident overcap fitted onto the shell with the cap fixed to the exterior of the first shell part and the tamper-evident member releasably secured around the exterior of at least part of the second shell part so that the cap cannot be removed before the tamper-evident member is released, and;

after the tamper-evident member is released the cap is removable together with the first shell part; wherein the first and second shell parts cannot be separated before the tamper-evident member is released, and after the tamper-evident member is released, the first shell part can be moved relative to the second shell part to open the tamper-evident closure.

2. The tamper-evident closure as claimed in claim 1, further comprising a first portion including inner and outer parts, and a second portion, the first portion being connected or connectable to the second portion and removable therefrom, the outer parts movable relative to the inner part upon first opening of the tamper-evident closure from a first position to a second position, and means for preventing the outer part from returning to the first position.

3. The tamper-evident closure as claimed in claim 2, in which the outer part is movable relative to the inner part from a first position in which the outer part is adjacent the second shell parts to a second position in which there is a gap therebetween, the tamper-evident closure comprising locking means for locking the outer part in the second position upon first opening of the tamper-evident closures so that the gap cannot easily be closed.

4. The tamper-evident closure as claimed in claim 3, in which the gap is one of: obstructed, unobstructed.

5. The tamper-evident closure as claimed in claim 2, in which the tamper-evident closure includes means for preventing the inner part from moving relative to the second portion until the outer part has reached the second position.

6. The tamper-evident closure as claimed in claim 2, in which the tamper-evident closure comprises a ratchet arrangement for preventing return to the first position.

7. The tamper-evident closure as claimed in claim 2, in which the second portion is attachable to a container.

8. The tamper-evident closure as claimed in claim 1, in which the first and second shell parts are joined by a line of weakness when the tamper-evident closure is in the unopened state.

9. The tamper-evident closure as claimed in claim 1, in which the releasable connection comprises a plurality of frangible bridges.

10. The tamper-evident closure as claimed in claim 1, in which the tamper-evident member includes anti-rotation features for engaging corresponding anti-rotation features on the second shell part.

11. The tamper-evident closure as claimed in claim 1, in which the cap is friction fitted onto the first shell part.

12. The tamper-evident closure as claimed in claim 1, in which the first shell part is rotatable relative to the second shell part to open the tamper-evident closure.

13. The tamper-evident closure as claimed in claim 1, in which the tamper-evident member is a tamper-evident band.

14. A tamper-evident closure as claimed in claim 13, in which the tamper-evident band has an upper edge and a lower edge, the upper edge frangibly connected to a free end of the cap and the lower edge unconnected.

15. A tamper-evident closure as claimed in claim 13, in which the tamper-evident band has a diameter that is greater than the diameter of the second shell part.

16. A tamper-evident closure as claimed in claim 13, in which the tamper-evident band has a frangible line that is breakable to release the tamper-evident band, the tamper-evident band has a generally disc-shape section and the frangible line extends one of: around one side of the generally disc-shape section, through the generally disc-shape section.

17. The tamper-evident closure as claimed in claim 1, in which when the tamper-evident closure is in the unopened state, the overcap prevents at least one of: axial separation of the first and second shell parts and relative rotation of the first and second shell parts.

18. The tamper-evident closure as claimed in claim 1 and a container.

19. A tamper-evident closure as claimed in claim 1, in which when the tamper-evident closure is in the unopened state, a periphery of the first shell part is immediately adjacent a periphery of the second shell part, and the tamper-evident member extends axially across the immediately adjacent peripheries of the first and second shell parts.

20. A tamper-evident overcap for use with a closure, the closure having a shell comprising a first shell part and a second shell part, the tamper-evident overcap comprising a cap and a tamper-evident member releasably connected to the cap by a releasable connection therebetween, the tamper-evident overcap fittable onto the shell with the cap fixed to the exterior of the first shell part of the closure and the tamper-evident member releasably secured to the exterior of the second shell part whereby when the tamper-evident overcap is arranged for use on the closure, the cap cannot be removed before the tamper-evident member is released, and after the tamper-evident member has been released, the cap is removable together with the first shell part; wherein the first and second shell parts cannot be separated before the tamper-evident member is released, and after the tamper-evident member is released the first shell part can be moved relative to the second shell part to open the tamper-evident closure; and wherein the tamper-evident member is a tamper-evident band having an upper edge and a lower edge, the upper edge frangibly connected to a free end of the cap and the lower edge unconnected.

* * * * *